US008339021B2

(12) United States Patent
Hanashi et al.

(10) Patent No.: US 8,339,021 B2
(45) Date of Patent: Dec. 25, 2012

(54) SPARK PLUG FOR INTERNAL-COMBUSTION ENGINE AND METHOD FOR MANUFACTURING THE SAME

(75) Inventors: Ken Hanashi, Handa (JP); Satoru Kadowaki, Mie-ken (JP); Tsunenobu Hori, Kariya (JP); Kenka Tsubota, Chiryu (JP); Hirotaka Aida, Toyota (JP); Hiroya Ishiguro, Kariya (JP)

(73) Assignee: Denso Corporation, Kariya (JP)

( * ) Notice: Subject to any disclaimer, the term of this patent is extended or adjusted under 35 U.S.C. 154(b) by 113 days.

(21) Appl. No.: 12/671,292

(22) PCT Filed: Jul. 31, 2008

(86) PCT No.: PCT/JP2008/063734

§ 371 (c)(1),
(2), (4) Date: Jul. 29, 2010

(87) PCT Pub. No.: WO2009/017187

PCT Pub. Date: Feb. 5, 2009

(65) Prior Publication Data

US 2010/0289397 A1 Nov. 18, 2010

(30) Foreign Application Priority Data

Jul. 31, 2007 (JP) ..... 2007-198628
Jul. 22, 2008 (JP) ..... 2008-188429

(51) Int. Cl.
*H01T 13/20* (2006.01)

(52) U.S. Cl. ..... 313/141

(58) Field of Classification Search ..... 313/141
See application file for complete search history.

(56) References Cited

U.S. PATENT DOCUMENTS 4,109,633 A 8/1978 Mitsudo et al.

(Continued)

FOREIGN PATENT DOCUMENTS

CN 02254403.8 9/2002

(Continued)

OTHER PUBLICATIONS

Russian Office Action received by Applicant's Agent on Nov. 29, 2010, issued in corresponding Russian Application No. 2010107198/07(010036), with English translation.

(Continued)

*Primary Examiner* — Karabi Guharay
*Assistant Examiner* — Michael Santonocito
(74) *Attorney, Agent, or Firm* — Nixon & Vanderhye PC

(57) ABSTRACT

A spark plug for an internal-combustion engine comprises an attachment fitting 2, an insulator 3, a center electrode 4 and an earth electrode 5. While fixed to the attachment fitting 2, the earth electrode 5 has a convex part 510 formed by projecting toward the center electrode 4 a part of the opposed surface 51, which faces the center electrode 4, of the earth electrode and a concave part 520 formed toward the opposed surface 51 from the earth electrode's back surface 52 which is the reverse side of the opposed surface 51 of the earth electrode 5. The convex part 510 is disposed so that the extension of a shaft center of the convex part 510 may pass through the area in which the concave part 520 is formed. A relation of S1>=s is realized when an area of an opening of the concave part 520 is set to S1 and an average cross-section area of a cross section of the convex part 510 perpendicular to an axial direction of the spark plug is set to s.

15 Claims, 21 Drawing Sheets

U.S. PATENT DOCUMENTS

| | | | | |
|---|---|---|---|---|
| 5,373,214 | A * | 12/1994 | McCready | 313/142 |
| 5,760,534 | A | 6/1998 | Bednář et al. | |
| 5,998,912 | A | 12/1999 | Schwab | |
| 6,215,234 | B1 * | 4/2001 | Abe et al. | 313/141 |
| 6,304,022 | B1 | 10/2001 | Matsutani | |
| 6,750,598 | B2 | 6/2004 | Hori | |

FOREIGN PATENT DOCUMENTS

| | | |
|---|---|---|
| DE | 38 20 552 | 12/1989 |
| JP | 52-36237 | 3/1977 |
| JP | 52-36238 | 3/1977 |
| JP | 55-001324 | 7/1980 |
| JP | 5-275157 | 10/1993 |
| JP | 11-204233 | 7/1999 |
| JP | 2003-317896 | 11/2003 |
| JP | 2006-73205 | 3/2006 |
| JP | 2006-316344 | 11/2006 |
| RU | 2 156 530 | 9/2000 |

OTHER PUBLICATIONS

International Search Report for PCT/JP2008/063734, mailed Oct. 7, 2008.

Microfilm of the specification and drawings annexed to the request of JP No. 1978-83501 (Laid-Open No. 1980-1324), Toyota Motor Co., Ltd., (Jan. 7, 1980), Full Text, drawings & abstract, 13 pages.

* cited by examiner

SPARK PLUG FOR INTERNAL-COMBUSTION ENGINE AND METHOD FOR MANUFACTURING THE SAME

This application is the U.S. national phase of International Application No. PCT/JP2008/063734 filed 31 Jul. 2008, which designated the U.S. and claims priority to Japan Application Nos. 2007-198628 filed 31 Jul. 2007 and 2008-188429 filed 22 Jul. 2008, the entire contents of each of which are hereby incorporated by reference.

TECHNICAL FIELD

The present invention relates to a spark plug for an internal-combustion engine used for a car, cogeneration, a gas pressure pump etc., and relates to a method for manufacturing the same.

BACKGROUND ART

As shown in FIG. 25, there is conventionally a spark plug 9 for an internal-combustion engine used as an ignition means of the fuel-air mixture introduced into a burner of internal combustion engine, such as a car (for example, see Patent Document 1).

The spark plug 9 has a center electrode 94 and an earth electrode 95.

The earth electrode 95 is fixed to an attachment fitting 92 and has a projection part 951. The projection part 951 is attached to the earth electrode 95's opposed surfaces which oppose the center electrode 94, so that the projection part 951 is provided opposite to the center electrode 94.

However, there is a following problem in the spark plug 9. That is, in the spark plug 9, since the projection part 951 is formed by attaching another component to the earth electrode 95, the man-hour in the manufacturing process of the spark plug 9 will increase. Consequently, there is a possibility that it may become difficult to raise the productivity of the spark plug 9. Moreover, in forming the projection part 951 with the precious metals etc., there is a possibility that material cost may become high.

On the other hand, as shown in FIG. 26, There is a spark plug 90 whose projection part 951 with a convex curved shape is integrally shaped with a flat earth electrode 95 by giving bending processing etc. to the flat earth electrode 95 (for example, see Patent Document 2). In the spark plug 90, in order to secure the amount of projection of the projection part 951, it is necessary to enlarge the depth of a concave part 952.

However, when the depth of the concave part 952 is enlarged, there is a possibility that the path of the earth electrode 95 for heat dissipation may become long. Consequently, heat dissipation of the earth electrode 95 cannot fully be performed, there is a possibility that it may become difficult to obtain the spark plug 90 excellent in heat resistance.

[Patent Document 1]

Japanese Patent Application Laid-Open No. 2003-317896

[Patent Document 2]

Japanese Patent Application Laid-Open No. S52-36238

DISCLOSURE OF THE INVENTION

Problems to be Solved by the Invention

The present invention has been made in view of the above conventional problems, and has an object to provide a spark plug excellent in productivity and heat resistance for internal-combustion engine.

Means for Solving the Problems

The first invention is a spark plug for an internal-combustion engine having an attachment fitting which provides a screw part to its outer circumference, an insulator held by the attachment fitting so that the insulator tip part may project, a center electrode held by the insulator so that the electrode tip part may project from the insulator tip part, and an earth electrode which forms a spark discharge gap between the center electrode and the earth electrode, wherein the earth electrode has a convex part formed by projecting toward the center electrode a part of the opposed surface, which faces the center electrode, of the earth electrode and a concave part formed toward the opposed surface from the earth electrode's back surface which is the reverse side of the opposed surface of the earth electrode while the earth electrode is fixed to the attachment fitting, the convex part is disposed so that the extension of a shaft center of the convex part may pass through the area in which the concave part is formed, and a relation of S1>=s is realized when an area of an opening of the concave part is set to S1 and an average cross-section area of a cross section of the convex part perpendicular to an axial direction of the spark plug is set to s (claim 1).

Next, operation effect of the present invention is explained.

the earth electrode has a convex part formed by projecting toward the center electrode a part of the opposed surface, which faces the center electrode, of the earth electrode. So, as described above, in the case of shaping the convex part integrally with the earth electrode, not forming the convex part by another component, the man-hour in the manufacturing process of a spark plug can be reduced. Consequently, the productivity of a spark plug can be raised.

Moreover, as described above, in the case of shaping the convex part integrally with the earth electrode, not forming the convex part by another component comprising a precious metal for example, material cost can be reduced and the spark plug of low cost can be obtained.

Furthermore, in the spark plug of the present invention, a relation of S1>=s is realized when an area of an opening of the concave part is set to S1 and an average cross-section area of a cross section of the convex part perpendicular to an axial direction of the spark plug is set to s. Forming the concave part by pushing out a part of the earth electrode's back surface results in projecting a part of the earth electrode's opposed surface whereby the convex part can be shaped, for example. However, since there is the relation of S1>=s, even if the depth of the concave part is small, the convex part can be fully projected. Therefore, sufficient thickness of the earth electrode near the concave part is acquired whereby the path of the earth electrode for heat dissipation can be also fully secured. Consequently, the spark plug excellent in heat resistance can be obtained.

Moreover, since the earth electrode is excellent in heat resistance as just described, even if it carries out spark discharge of it toward the convex part under a high temperature environment, oxidation and melting of the convex part can be prevented whereby the convex part can be prevented from deteriorating. Consequently, the spark plug excellent in sparking wear resistance can be obtained.

In addition, since the thickness of the earth electrode in the neighborhood of the concave part is fully securable as described above, intensity of the earth electrode can be secured whereby shear crack can be prevented.

As described above, according to the present invention, the spark plug excellent in productivity and heat resistance for internal-combustion engine can be provided.

The second invention is a method for manufacturing the spark plug for an internal-combustion engine comprising steps of laying the approximately flat earth electrode on a metallic mold which has a cavity for convex part for shaping the convex part in the state where the cavity for convex part opposes the opposed surface, forming the concave part by pressing a part of the earth electrode's back surface with a pressing jig for forming the concave part and forming the convex part by pushing out a part of the earth electrode to the cavity for convex part (claim 8).

Next, operation effect of the present invention is explained.

With the pressing jig for forming the concave part, while the concave part is formed by pressing a part of the earth electrode's back surface, the convex part is formed by pushing out a part of the earth electrode to the cavity for the convex part. That is, according to the present invention, the convex part can be shaped integrally in the earth electrode whereby the man-hour in the manufacturing process of a spark plug can be reduced. Consequently, the method for manufacturing the spark plug for internal-combustion engine excellent in productivity can be provided.

Moreover, it is not necessary to form the convex part with another component which consists of precious metals, for example, whereby material cost can be reduced.

Moreover, as described above, while the concave part is formed by pressing a part of the earth electrode's back surface, the convex part is formed by pushing out a part of the earth electrode to the cavity for the convex part. Namely, according to the above method, it is possible to make the volume of the concave part and the volume of the convex part approximately the same. So, when the convex part is shaped so that the relation of S1>=s may be realized, the convex part can be made to fully project even if the depth of the concave part is small. Therefore, by the method, the spark plug according to the first invention, i.e., the spark plug excellent in heat resistance can be obtained easily.

As described above, according to the present invention, the method for manufacturing the spark plug for internal-combustion engine excellent in productivity and heat resistance can be provided.

DESCRIPTION OF REFERENCE SYMBOLS

Figure 1:
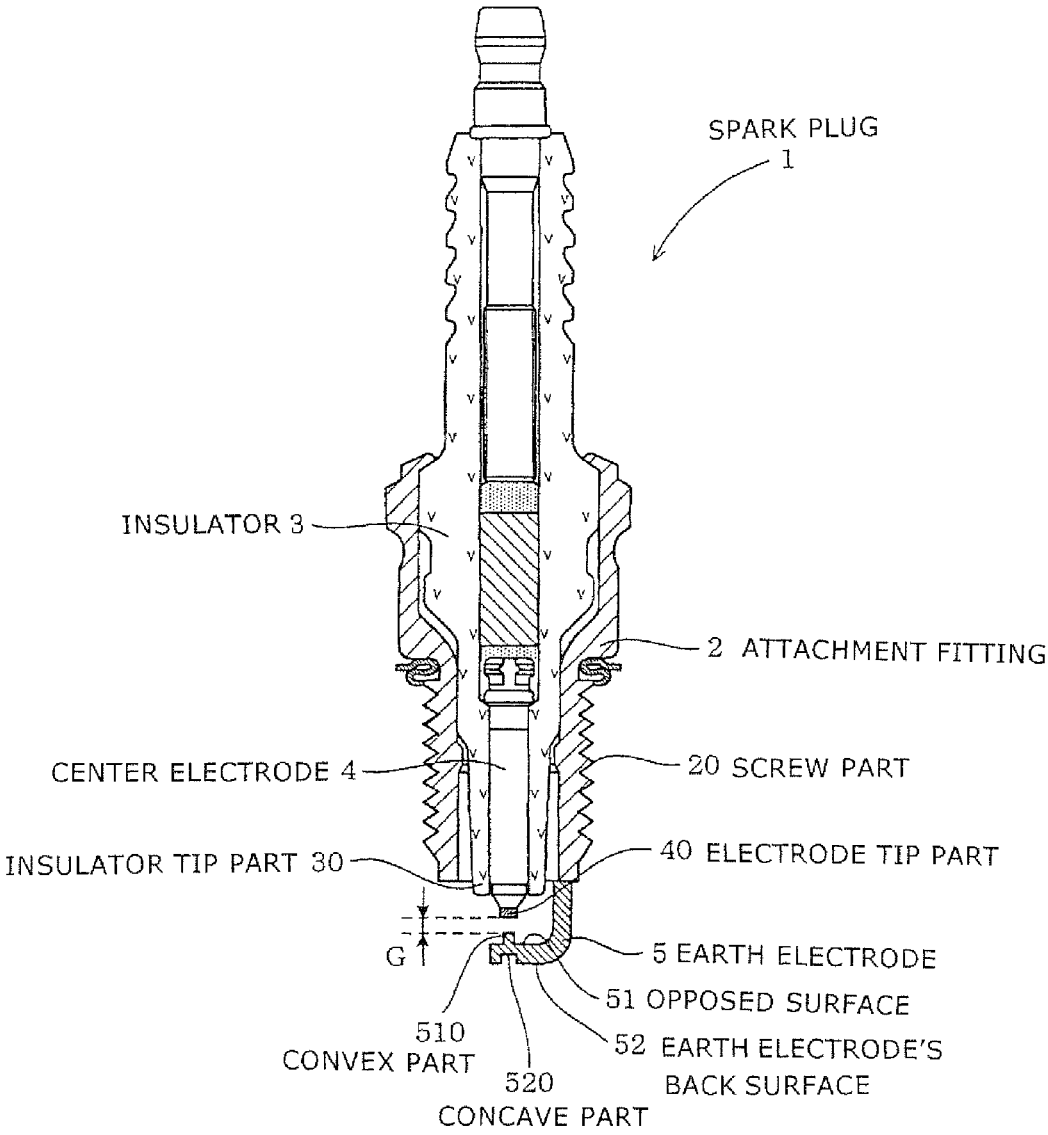
FIG. 1 is a longitudinal sectional view of the spark plug in the first embodiment.
Figure 2:
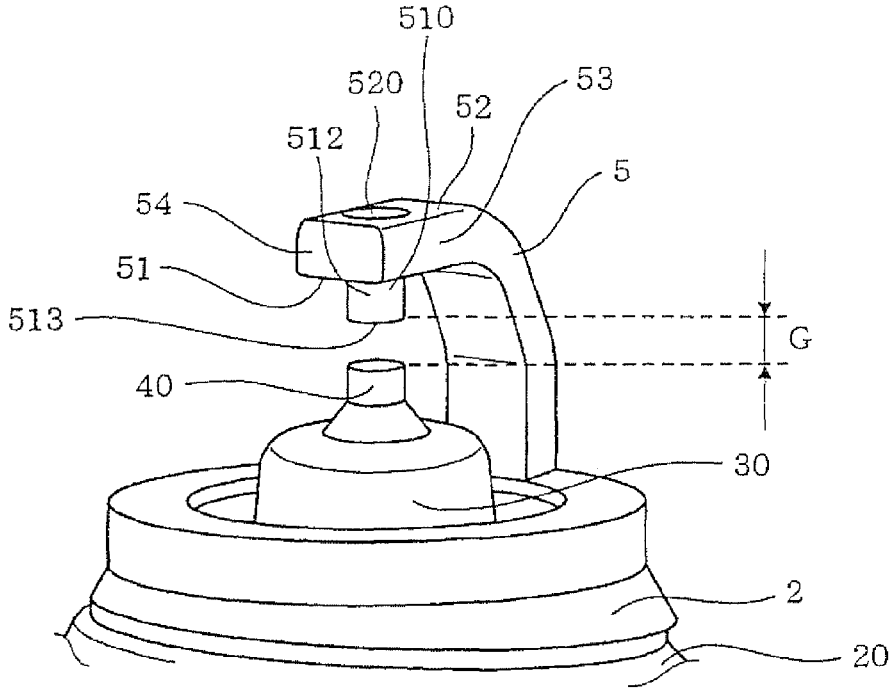
FIG. 2 is a perspective view of the tip part of a spark plug in the first embodiment.

1 . . . Spark plug
2 . . . Attachment fitting
20 . . . Screw part
3 . . . Insulator
30 . . . Insulator tip part
4 . . . Center electrode
40 . . . Electrode tip part
5 . . . Earth electrode
51 . . . Opposed surface
510 . . . Convex part
52 . . . Earth electrode's back surface
520 . . . Concave part

BEST MODE FOR CARRYING OUT THE INVENTION

The spark plug for the internal-combustion engine of the first and second inventions can be used as an ignition means of the internal-combustion engine in a car, cogeneration, a gas pressure pump, etc.

In the spark plug of the first and second inventions, the side inserted into a combustion chamber of an internal-combustion engine is explained as a tip end side, and its opposite side is explained as a base end side.

The average cross-section area s of the convex part is a value which is obtained by dividing a volume of the convex part by the amount of projection of the convex part.

Moreover, in the spark plug, when the average cross-section area of the section of the concave part which intersects perpendicularly with the axial direction of the spark plug is set to S2, it is desirable that a relation of S2>=is realized.

The convex part can be made to fully project even if the depth of the concave part is small. So, the spark plug excellent in productivity and heat resistance can be obtained.

The average cross-section area S2 of the concave part is the value which is obtained by dividing a volume of the concave part by the depth of the concave part.

Moreover, in the spark plug, when the thickness of the earth electrode is set to T, and the depth of the concave part in the axial direction of the spark plug is set to H, it is desirable that a relation of H<=(3/4) T is realized.

In this case, the thickness of the earth electrode near the concave part is fully securable. Consequently, the spark plug which is further excellent in heat resistance can be obtained.

Moreover, when both the convex part and the concave part have approximately cylindrical shapes, the diameter of the convex part is set to d and the diameter of the concave part is set to D, it is desirable that the relation of D>=d is realized.

In this case also, the spark plug excellent in productivity and heat resistance can be obtained.

Moreover, in the spark plug, when the amount of projection of the convex part in the axial direction of the spark plug is set to h and the amount of projection of the concave part in the axial direction of the spark plug is set to H, it is desirable that a relation of H<=2h is realized.

In this case, while making the convex part fully project, the thickness of the earth electrode near the concave part is fully securable. Consequently, the spark plug which is fully excellent in ignition performance and heat resistance can be obtained.

In addition, it is more desirable that a relation of H<=h is realized.

Moreover, it is desirable that the convex part has a groove portion concaved toward the earth electrode's back surface in the earth electrode's top surface opposed to the center electrode.

In this case, the overall length of a corner part in the top surface of the convex part can be lengthened. Thereby, a plurality of intense electric fields can be formed and required voltage can be reduced. Consequently, the ignition performance of the spark plug can be raised.

Moreover, a chip made of precious metals containing any one of Pt, Ir, Rh, and W as a major component may be welded to the earth electrode's top surface of the earth electrode opposed to the center electrode.

In this case, the spark plug of low cost and excellent in ignition performance can be obtained. That is, as mentioned above, when attaching the chip of the precious metals to the top surface of the convex part further, even if it is the case where the amount h of projection from the opposed surface is made the same, consumed quantity of the precious metals can be lessened by the quantity of the convex part formed to the earth electrode rather than the case where the chip is simply attached to the opposed surface. For this reason, the material cost of the spark plug can be reduced. Furthermore, since the chip is attached in the direction which approaches the electrode tip part further rather than the top surface of the convex part, required voltage can be reduced rather than the case where the convex part is simply provided whereby the ignition performance of the spark plug can be raised.

Moreover, in the second invention, it is desirable that the earth electrode is pressed with the pressing jig in the state where both sides in a width direction of the earth electrode contact lateral contacting surfaces provided to the metallic mold.

In this case, when some part of the earth electrode is pressed with the pressing jig, the earth electrode can be prevented from deforming so as to spread to a width direction whereby the convex part can be made to project certainly.

Moreover, it is desirable that the earth electrode is pressed with the pressing jig in the state where the tip portion of the earth electrode contacts the lateral contacting surfaces provided to the metallic mold.

In this case, when some part of the earth electrodes is pressed with the pressing jig, the earth electrode can be prevented from deforming so as to spread to the tip direction whereby the convex part can be made to project certainly.

Moreover, it is desirable that a movable mold slidable to the cavity for convex part is inserted into the metallic mold, and in the movable mold which opposes the earth electrode is formed into a planar shape, a tip portion of the convex part is shaped with the mold surface of the movable mold when the convex part is formed by pushing out a part of the earth electrode to the cavity for convex part.

In this case, the top surface of the convex part can be shaped in a planar shape with a tabular mold surface whereby it becomes easy to form a corner part between the top surface and the side of the convex part.

Here, when the spark plug is used by attaching to an internal-combustion engine, in an initial state, sparks discharge toward the corner part from the electrode tip part. By this spark discharge, the convex part is wasted gradually from the corner part, and after the corner part is lost, consumption of the whole convex part advances, and the spark discharge gap expands. That is, in the spark plug manufactured by the method, the convex part can be first wasted from the corner part. Therefore, the life of the convex part, i.e., the life of the spark plug can be lengthened by the amount equivalent to that of the corner part of the convex part.

Moreover, the amount of projection of the convex part can be easily adjusted by adjusting the position of the movable mold.

Furthermore, the movable mold is slidable to the cavity for the convex part whereby the earth electrode can be demolded more easily from the metallic mold after the convex part is shaped.

Moreover, the part of the earth electrode's back surface may be pressed twice or more with the pressing jig in the step of forming the convex part.

In this case, the corner part can be formed certainly to the top surface of the convex part. That is, even if the corner part cannot be fully formed to the top surface by pressing once with the pressing jig, the corner part can be certainly formed to the top surface by pressing twice or more. Thereby, required voltage can be reduced and the spark plug which is excellent in ignition performance can be obtained.

Moreover, it is desirable that the metallic mold has a movable mold provided with a groove formation part for forming a groove portion provided in the convex part and concaved toward the earth electrode's back surface in the earth electrode's top surface opposed to the center electrode.

In this case, as same as in the case of claim 6, a plurality of intense electric fields can be formed and required voltage can be reduced whereby the ignition performance of the spark plug can be raised.

Moreover, a chip made of precious metals containing any one of Pt, Ir, Rh, and W as a major component may be welded to the earth electrode's top surface of the earth electrode opposed to the center electrode after forming the convex part.

In this case, as same as in the case of claim 7, while the material cost of the spark plug can be reduced, the ignition performance of the spark plug can be raised.

EMBODIMENTS

First Embodiment

Using FIG. 1-FIG. 7, the spark plug for internal-combustion engine concerning an embodiment of the present invention is explained.

As shown in FIG. 1, the spark plug 1 of the present embodiment comprises an attachment fitting 2 which has a screw part 20 at the perimeter, an insulator 3 held by the attachment fitting 2 so that an insulator tip part 30 may project, a center electrode 4 held by the insulator 3 so that an electrode tip part 40 may project from the insulator tip part 30, and the earth electrode 5 which forms a spark discharge gap G between the earth electrode 5 and the center electrodes 4.

As shown in FIG. 1-FIGS. 3A and 3B, the earth electrode 5 has a convex part 510 formed by projecting toward the center electrode 4 a part of the earth electrode's opposed surface 51 which opposes the center electrode 4 and a concave part 520 formed toward the opposed surface 51 in the earth electrode's back surface 52 on the side opposite to the opposed surface 51 of a grounding base material 50 while the earth electrode is fixed to the attachment fitting 2.

The convex part 610 is disposed so that the extension of a shaft center of the convex part 520 may pass through the area in which the concave part 520 is formed.

Moreover, when an area of an opening 523 of the concave part 520 is set to S1 and an average cross-section area of a cross section of the convex part 510 perpendicular to an axial direction of the spark plug 1 is set to s, a relation of S1>=s is realized. Here, the average cross-section area s of the convex part 510 is value NO which is obtained by dividing a volume of the convex part 510 by the amount h of projection of the convex part 510.

Figure 3:
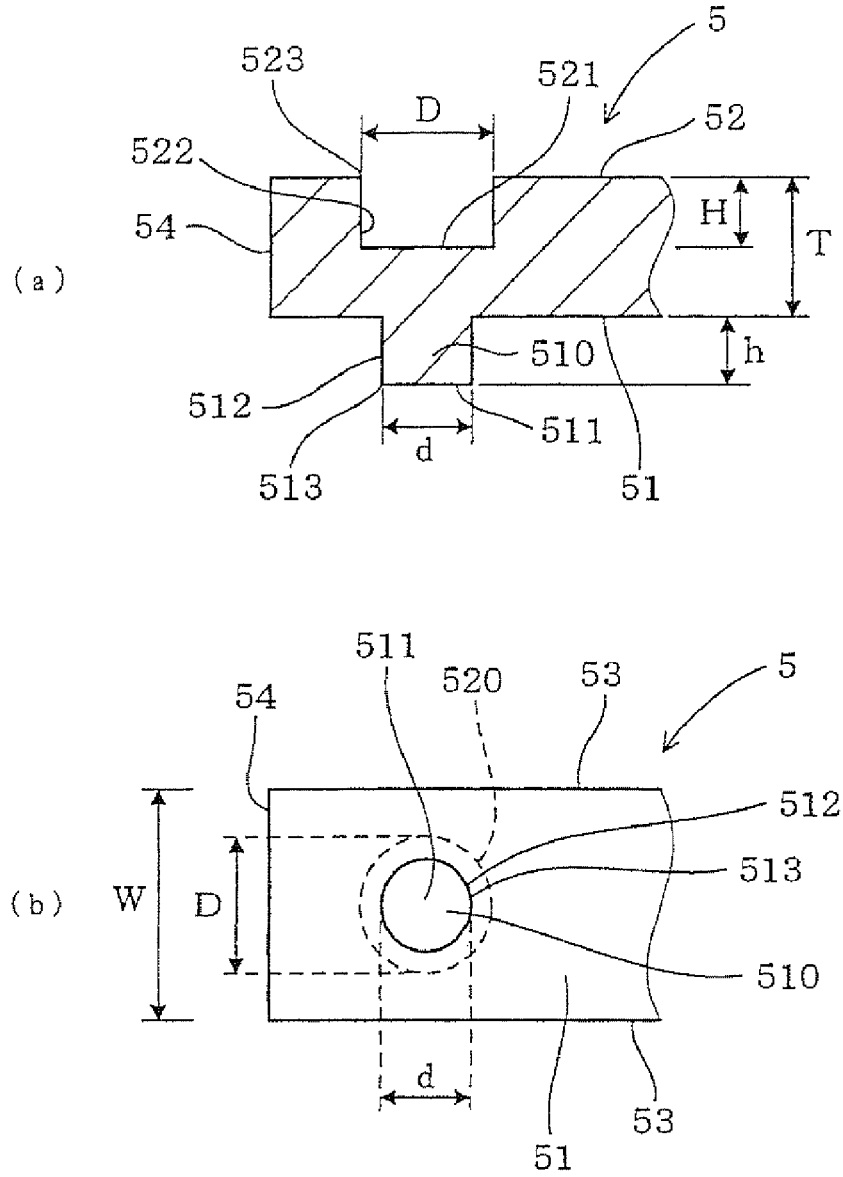
FIG. 3(*a*) is a sectional view of the tip part of the earth electrode, and FIG. 3(*b*) is a top view of the tip part of the spark plug in the first embodiment.

Moreover, in the present embodiment, both the convex part 510 and concave part 520 have approximately cylindrical shapes. Therefore, as shown in FIG. 3 for example, if the diameter of the concave part 520 is set to d, and the diameter of the concave part 520 is set to D, the relation of D>=d is realized in the spark plug 1 of the present embodiment.

The spark plug 1 can be used, for example, as an ignition means of the internal-combustion engine in a car, cogeneration, gas pressure pump, etc.

As described above, the spark plug 1 comprises the attachment fitting 2 which has the screw part 20 at the perimeter. The spark plug 1 is screwed to a wall part of the burner (not illustrated in the drawings) of the internal-combustion engine at the screw part 20. Moreover, the earth electrode 5 is formed in bent shape so that one end of the earth electrode 5 is joined to the tip side of the attachment fitting 2 and the convex part 510 formed at the other end of the earth electrode 5 is disposed to the position opposed to the electrode tip part 40 of the center electrode 4.

The electrode tip part 40 of the center electrode 4 of the present embodiment may consist of a chip of the precious metals containing Ir, Rh, Ru, etc.

For example, the earth electrode 5 may consist of a nickel base alloy which contains nickel as a major ingredient and Ti.

Moreover, in the spark plug 1 of the present embodiment, the diameter d of the convex part 510 may be set to 1.5 mm, the diameter D of the concave part 520 may be set to for the diameter D of the concave part 520 may be set to 1.7 mm and the width W of the earth electrode 5 may be set to 2.8 mm for example. That is, in the spark plug 1 of the present embodiment, the relation of W>D besides the relation of D>=d as described above is realized.

Moreover, thickness T of the earth electrode 5 can be set to 1.6 mm. That is, the relation of H<=(¾) T is realized in the spark plug 1 of the present embodiment.

The convex part 510 has a corner part 513 between a top surface 511 and a side surface 512 while the top surface 511 is formed as a flat side.

Figure 7:
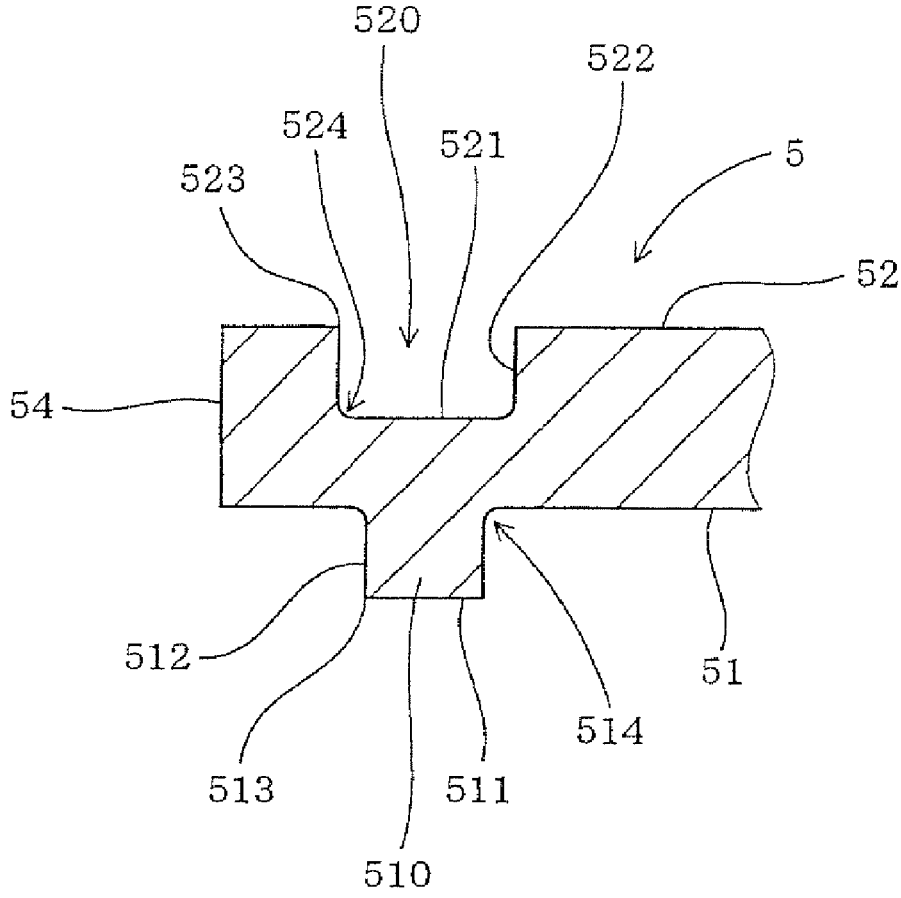
FIG. 7 is a sectional view of the tip portion of the earth electrode which has curved surfaces in the base part of the convex part and the bottom part of the concave part in the first embodiment.

In addition, as shown in FIG. 7, a base part 514 of the convex part 510 can be formed of a curved surface, and a bottom corner part 524 of the concave part 520 can also be formed of a curved surface. In this case, by setting the curvature radius in the base part 514 of the convex part 510 and the curvature radius in the bottom corner part 524 of the concave part 524 to 0.1 mm or more respectively, stress concentration at the base part 514 and the bottom corner part 524 after shaping can be controlled. Thereby, cracking in the earth electrode 5 can be controlled also under cold/hot environment at the time of engine operation.

In addition, the amount h of projection of the convex part 510 in the axial direction of the spark plug 1 of the present embodiment is set to 0.7 mm and the depth H of the concave part 520 in the axial direction of the spark plug 1 is set to 1.1 mm. Thus, the relation of H>h is realized in the spark plug 1 of the present embodiment. The depth H of the concave part 520 is larger than the amount h of projection of the convex part 510, and the volume of the concave part 520 is larger than the volume of the convex part 510, because some portion of the earth electrode 5 inevitably spreads into portions other than the convex part 510 during shaping the convex part 510. Therefore, it is desirable to control spreading of the earth electrode 5 into portions other than the convex part 510, for example, by making a cross section perpendicular to the axial direction of the earth electrode 5 illimitably into rectangular geometry etc.

In addition, the amount h of projection is not restricted to the value mentioned above, for example, can be set to 0.3 mm<=h<=1.1 mm.

When the amount h of projection of the convex part 510 is 0.3 mm or more, the ignition performance of the spark plug can be raised. That is, by separating the opposed surface 51 of the earth electrode 5 0.3 mm or more from an initial flame which is caused from fuel-air mixture lit by electric discharge sparks, the initial flame can be made easy to burn and spread, whereby the ignition performance of the spark plug can be raised.

Alternatively, when the amount h of projection of the convex part 510 is smaller than 1.1 mm, the rise in heat of the tip part of the convex part 510 can be controlled, whereby the pre-ignition under engine operation can be controlled.

Next, an example of the measurement method of each size mentioned above is shown.

That is, the size of each part is measured in the cross section of the machining portion of the earth electrode 5 as shown in FIGS. 3A and 3B for example. In this measurement, for example, a projector may be used for magnifications, such as 10 times, or a close-up picture may be used for the measurement.

Specifically, the diameter d of the convex part 510 is obtained by measuring the length of the width direction of the convex part 510 in the cross section. Similarly, the diameter D of the concave part 520 is obtained by measuring the length of the width direction of the concave part 520 in the cross section.

Also, the amount h of projection of the convex part 510 is obtained by measuring the length from the earth electrode's back surface 52 of the earth electrode 5 to the top surface 511 of the convex part 510 in the cross section. Similarly, the depth H of the concave part 520 is obtained by measuring the length from the earth electrode's back surface 52 of the earth electrode 5 to a bottom part 521 of the concave part 520.

Figure 4:
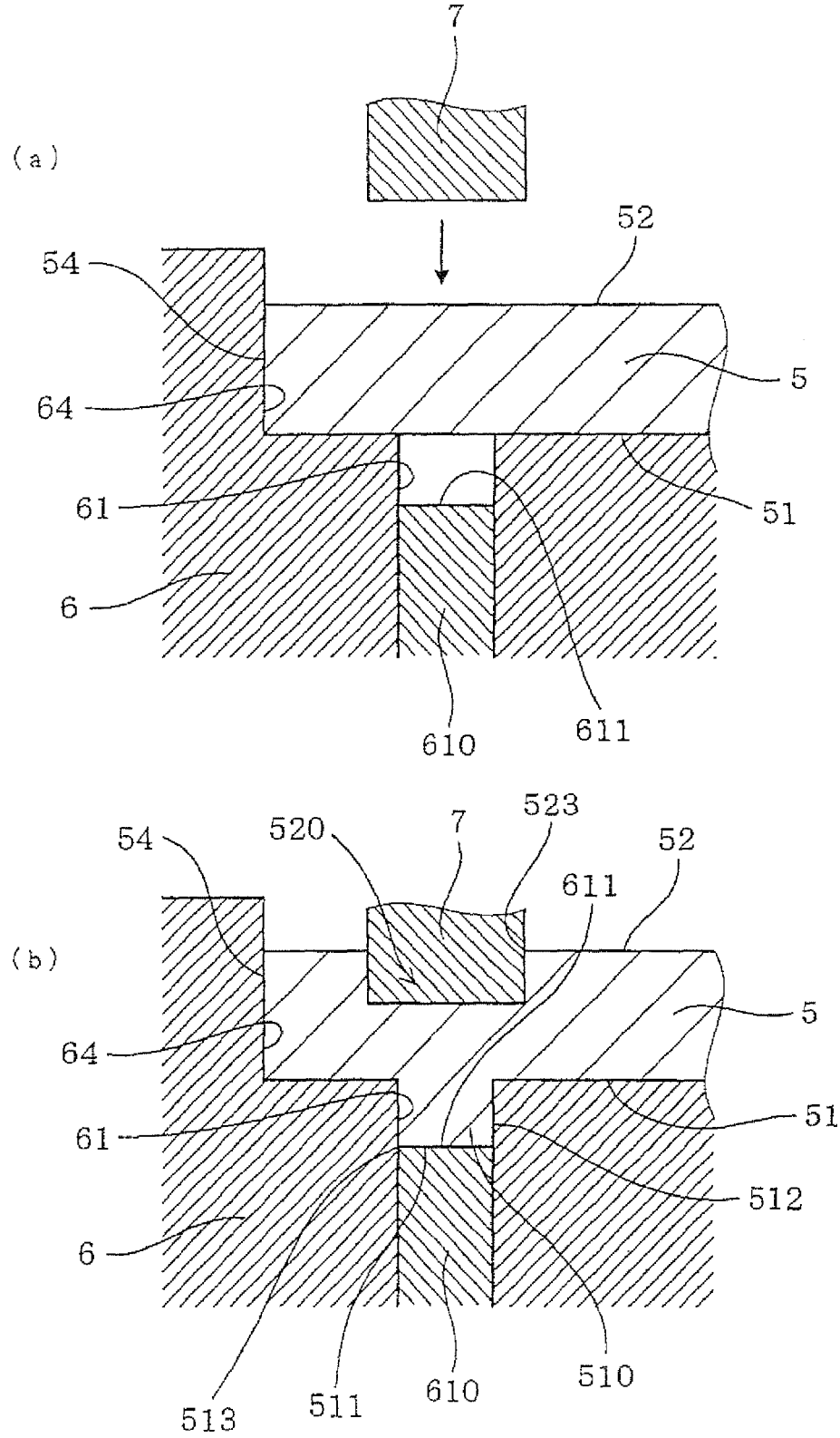
FIG. 4(*a*) is an explanatory diagram illustrating the state before the convex part and the concave part are shaped, and FIG. 4(*b*) is an explanatory diagram illustrating the state after the convex part and the concave part are shaped in the first embodiment.
Figure 5:
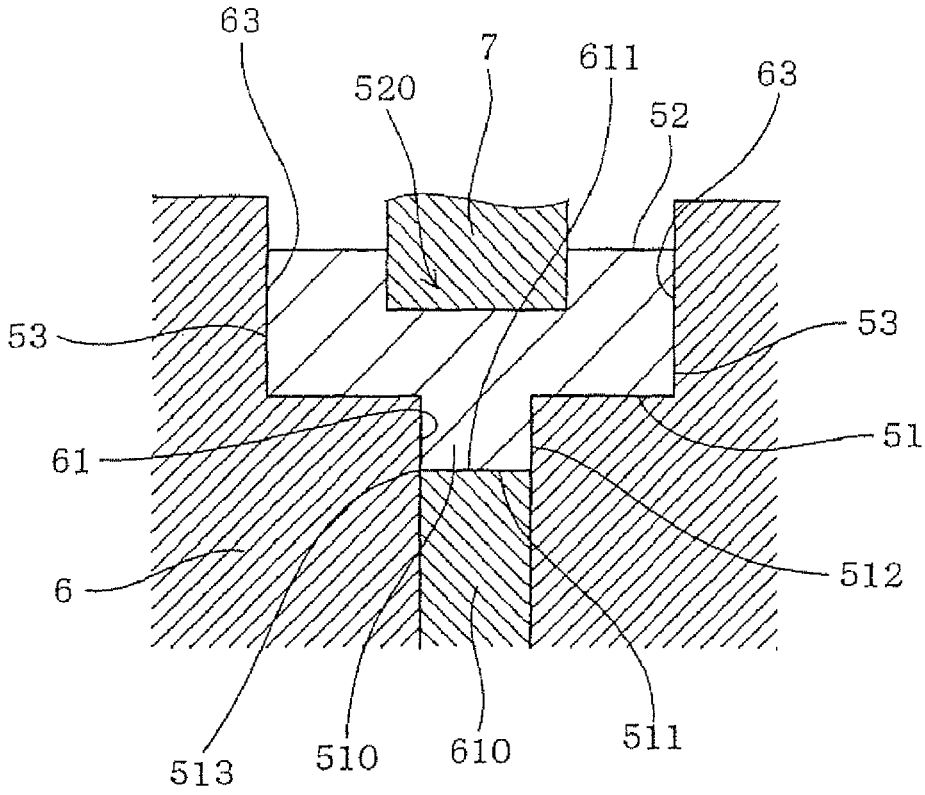
FIG. 5 is an explanatory diagram illustrating the state after the convex part and the concave part are shaped in the first embodiment.
Figure 6:
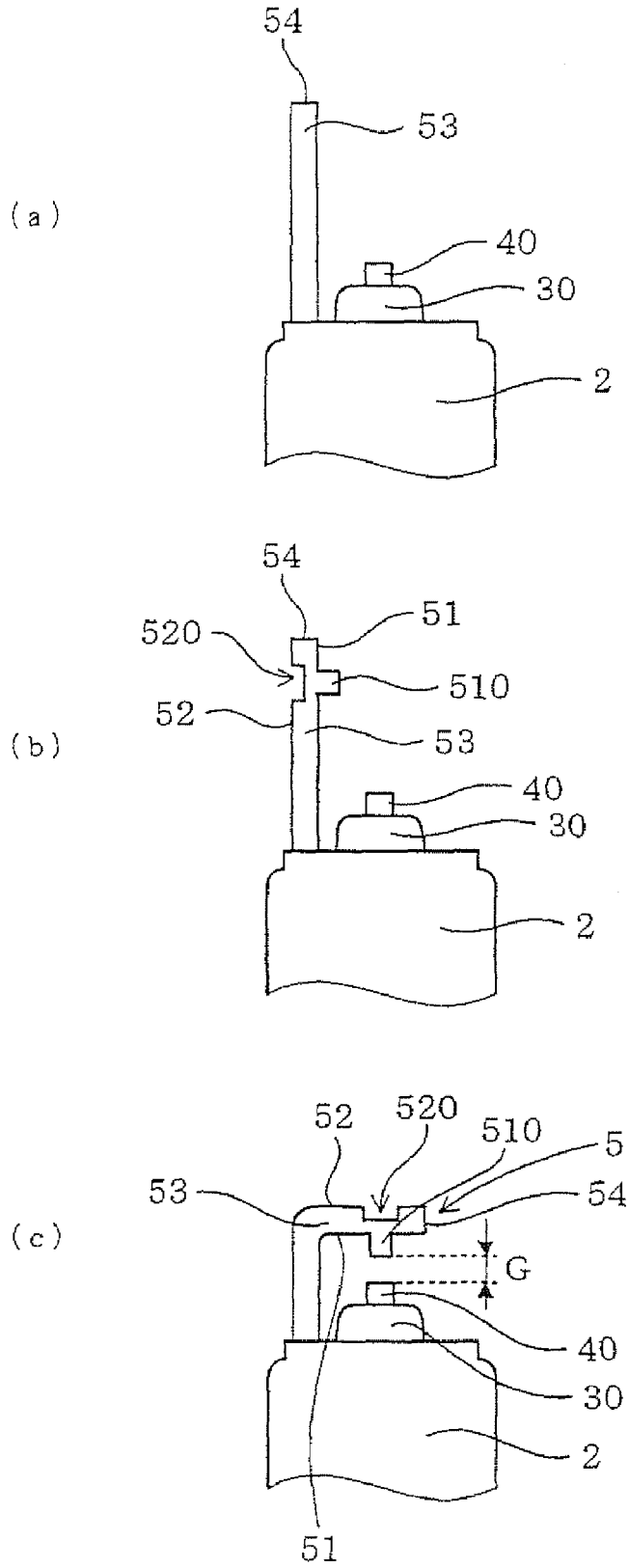
FIG. 6(*a*) is an explanatory diagram illustrating the state of the tip part of the spark plug before the convex part and the concave part are shaped, FIG. 6(*b*) is an explanatory diagram illustrating the state of the tip part of the spark plug after the convex part and the concave part are shaped, and FIG. 6(*c*) is an explanatory diagram illustrating the state of the tip part of the spark plug where a spark discharge gap was formed in the first embodiment.

Next, a method for manufacturing the spark plug 1 of the present embodiment is explained using FIG. 4-FIG. 6.

First, as shown in FIG. 6(*a*), the center electrode 4 grade is inserted into the inside of the attachment fitting 2 fixing the approximately flat earth electrode 5.

Next, as shown in FIG. 4(*a*), the earth electrode 5 is laid on a metallic mold 6 which has a cavity 61 of approximately cylindrical shape for shaping the convex part 520 in the state where the cavity 61 for convex part and the opposed surface 51 were opposed to each other. At this time, as shown in FIG. 4 and FIG. 5, the earth electrode 5 is laid on the metallic mold 6 in the state where both side surfaces 53 of the width direction and a tip portion 54 contact a side contacting surface 63 and a tip contacting surface 64 disposed to the metallic mold 6.

Furthermore, a movable mold 610 slidable to the cavity 61 for convex part is inserted in the metallic mold 6. In the movable mold 6 a mold surface 611 which opposes the earth electrode 5 is formed in a planar shape. The amount h of projection of the convex part 510 can be changed by adjusting the position of the movable mold 610 in the cavity 61 for convex part.

Meanwhile, a pressing jig 7 has an approximately cylindrical shape as well as the cavity 61 for convex part, and the pressing jig 7 is made so that the cross-section area of the cross section perpendicular to the movable direction of the pressing jig 7 may become larger than the cross-section area of the cavity 61 for convex part.

Then the convex part 510 is shaped by giving cold-hammer processing to the approximately flat earth electrode 5 with the metallic mold 6 and the pressing jig 7. As specifically shown in FIG. 4(*b*) and FIG. 5, while the concave part 520 is formed by pressing a part of the earth electrode's back surface 52 with the pressing jig 7, the convex part 510 is shaped by pushing out a part of the earth electrodes 5 to the cavity 61 for convex part. That is, a part of the opposed surface 51 is pushed out, the same amount of the earth electrode 5 as of the pushed out opposed surface 51 is projected into inside the cavity 61, whereby the convex part 510 is shaped.

When a part of the earth electrode's back surface 52 is pushed out with the pressing jig 7, as shown in FIG. 4(*b*) and FIG. 5, the earth electrode 5 is pressed with the pressing jig 7 in the state where the is earth electrode 5 keeps contacting the side contacting surface 63 and the tip contacting surface 64. Therefore, the same amount of the convex part 510 as of the part of the pushed out opposed surface 51 can be fully projected. However, since all of the volume of the concave part 520 pushed out with the pressing jig 7 may not become the convex part 510 as mentioned above, while making the cross section perpendicular to the axial direction of the earth electrode 5 illimitably into rectangular geometry, it is desirable to make the earth electrode 5 fully contact the side contacting surfaces 63 and the tip contacting surface 64. Namely, according to the method, the volume of the concave part 520 and the volume of the convex part 510 can be approximately equal whereby the spark plug with which the relation of H>=h is realized can be constituted.

The top surface 511 of the convex part 510 is shaped by a part of the earth electrodes 5 contacting the mold surface 611 of the movable mold 610.

Subsequently, the fabricated earth electrode 5 is demolded from the metallic mold 6 by pushing out the movable mold 610 to the direction of the earth electrode 5 and pulling out the convex part 510 from the cavity 61 for convex part.

Subsequently, as shown in FIG. 6(*c*), the earth electrode 5 is formed in a bent shape so that the electrode tip part 40 and the convex part 510 may oppose each other. One end of the earth electrode 5 is joined to the tip side of the attachment fitting 2 and the convex part 510 formed at the other end of the earth electrode 5 is disposed to the position opposed to the electrode tip part 40 of the center electrode 4. Thereby, the spark discharge gap G is formed between the electrode tip part 40 and the convex part 510.

Next, operation effect of the present invention is explained.

the earth electrode has the convex part 510 formed by projecting toward the center electrode 4 a part of the opposed surface 51, which faces the center electrode 4, of the earth electrode 6. That is, in the present embodiment, the convex part 510 is shaped integrally with the earth electrode 5. So, it is not necessary to establish the process which attaches a convex part formed by another component to the earth electrode 5, whereby the man-hour in the manufacturing process of the spark plug 1 can be reduced.

As described above, since the convex part 510 is shaped integrally with the earth electrode 5, it is not necessary to form the convex part 510 with another component consisting of, for example, precious metals. Therefore, material cost can be reduced and the spark plug 1 of low cost can be obtained.

As a result, the productivity of the spark plug 1 can be raised.

Besides, in the spark plug 1 of the present embodiment, when the area of an opening 523 of the concave part 520 is set to S1 and the average cross-section area of the convex part 510 is set to s, the relation of S1>=s is realized. Here, forming concave part 520 by pushing out a part of the earth electrode's back surface 52 makes a part of the opposed surface 51 of the earth electrode 5 projected, thus the convex part 510 can be shaped. However, since there is a relation of S1>=s, even if depth H of the concave part 520 is small, the convex part 510 can be fully projected. So, the thickness of the earth electrode 5 in the neighborhood of the concave part 520 is fully securable, whereby a heat dissipation path of the earth electrode 5 is also fully securable. Consequently, the spark plug 1 excellent in heat resistance can be obtained.

Moreover, since the earth electrode 5 is excellent in heat resistance in this way, even if spark discharge is carried out to the convex part 510 under high temperature environment, oxidation and melting of the convex part 510 is prevented whereby the convex part 510 can be prevented from being exhausted. Consequently, the spark plug 1 excellent in sparking wear resistance can be obtained.

Besides, as described above, since the thickness of the earth electrode 5 in the neighborhood of the concave part 520 is fully securable, intensity of the earth electrode can be secured whereby shear crack can be prevented.

Moreover, the relation of H<=(¾) T is realized in the spark plug 1. Thereby, the thickness from depth H of the concave part 520 in the earth electrode 5 to the opposed surface 51 is fully securable. Therefore, the spark plug 1 further excellent in heat resistance can be obtained.

Since both the convex part 510 and the concave part 520 have approximately cylindrical shapes and the relation of D>=d is realized, the spark plug 1 further excellent in productivity and heat resistance can be obtained.

Moreover, the earth electrode 5 is pressed with the pressing jig 7 in the state where the both side surfaces 53 of a width direction and the tip portion 54 were made to contact the side contacting surfaces 63 and tip contacting surface 64 which are provided in the metallic mold 6. Thereby, in case that the earth electrode 5 is pressed with the pressing jig 7, the earth electrode 5 is prevented from deforming so that the earth electrode 5 may spread in the width direction and the tip direction, whereby the convex part 510 can be projected certainly.

The movable mold 610 slidable to the cavity 61 for convex part is inserted in the metallic mold 6. In the movable mold 6 a mold surface 611 which opposes the earth electrode 5 is formed in a planar shape. When the convex part is shaped by pushing out a part of the earth electrodes 5 to the cavity 61 for convex part, the top surface 511 of the convex part 510 is shaped with the mold surface 611 of the movable mold 610. Thereby, the top surface 511 of the convex part 510 can be formed into a planar shape by the tabular mold surface 611 whereby it becomes easy to form the corner part 513 between the top surface 511 and the side surface 512 of the convex part 510.

Here, in the case where the spark plug 1 is assembled to an internal-combustion engine and used, in an initial state, sparks discharge toward the corner part 513 from the electrode tip part 40. Then by spark discharge, the convex part 510 gradually exhausts from the corner part 513, after the corner part 513 is lost, exhaustion of the convex part 510 whole advances, and the spark discharge gap G expands. That is, in the spark plug 1 manufactured by the method, the convex part 510 can be first exhausted from the corner part 513. Therefore, the life of the convex part 510, i.e., the life of the spark plug 1 can be lengthened by the amount equivalent to that of the corner part 513 of the convex part 510.

Moreover, the amount h of projection of the convex part 510 can be easily adjusted by adjusting the position of the movable mold 610.

Furthermore, since the movable mold 610 is slidable to the cavity 61 for convex part, after the convex part 510 is shaped, the earth electrode 5 can be demolded more easily from the metallic mold 6.

According to the present embodiment, as described above, the spark plug for the internal-combustion engine excellent in productivity and heat resistance and method for manufacturing the same can be provided.

Second Embodiment

Figure 8:
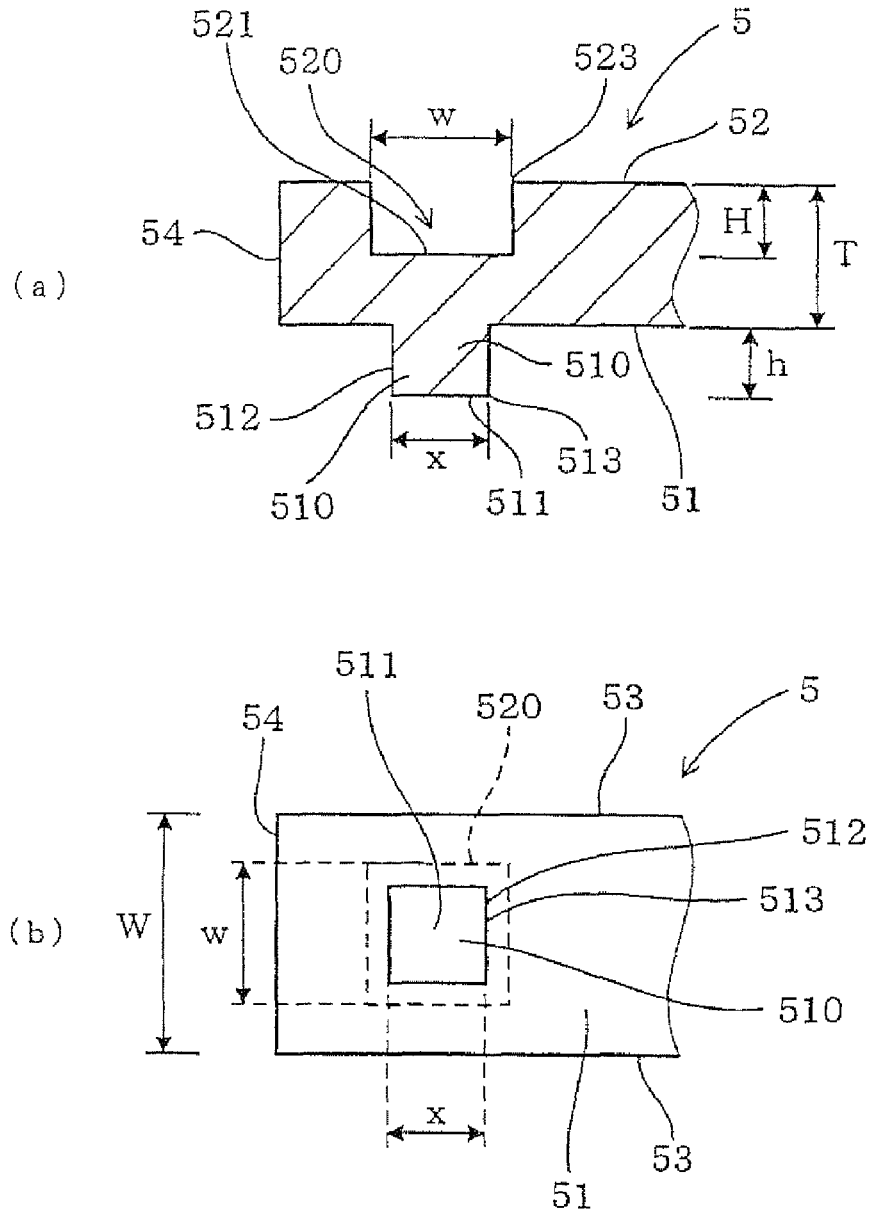
FIG. 8(*a*) is a sectional view of the tip part of the earth electrode, and FIG. 8(*b*) is a top view of the tip part of the earth electrode in the second embodiment.

The present embodiment is, as shown in FIG. 8, an example of both the convex part 510 and concave part 520 of the earth electrode 5 have an approximately rectangular column shape. That is, the earth electrode 5 of the present embodiment is produced using the metallic mold 6 having the cavity 61 for convex part with approximately rectangular column shape, and the pressing jig 7 with approximately rectangular column shape.

In the spark plug 1 of the present embodiment, when the cross-section area in the cross section, perpendicular to the axial direction of the spark plug 1, of the convex part 510 is set to a, and the cross-section area in the cross section, perpendicular to the axial direction of the spark plug 1, of the concave part 520 is set to A, the relation of A>=a is realized. Here, shapes of both the convex part 510 and the concave part 520 are square shape when viewed from the axial direction of the spark plug 1. That is, a length x of one side of the convex part 510 and a length w of one side of the concave part 520 have the relation of w>x.

Moreover, the length w of one side of the concave part 520 and the width W of the earth electrode 5 have the relation of W>w.

Others have the same composition and the operation effect as those of the first embodiment.

Third Embodiment

Figure 9:
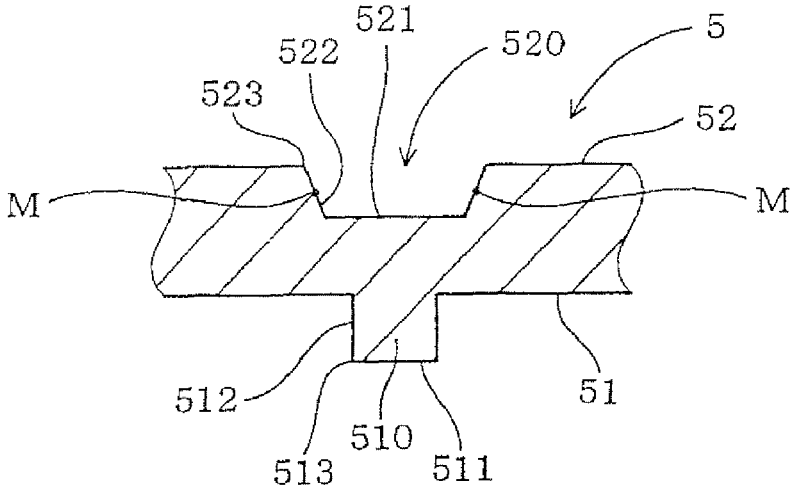
FIG. 9 is a sectional view of the earth electrode in third embodiment.

As shown in FIG. 9, the present embodiment is an example of the earth electrode 5 having the convex part 510 whose cross section is approximately rectangular when the earth electrode 5 is in parallel with the axial direction of the earth electrode 5, and the concave part 520 whose cross section is approximately trapezoidal when the earth electrode 5 is in parallel with the axial direction of the earth electrode 5.

That is, in the concave part 520, two border lines of side surface 522 of the concave part 520 which appears in the cross section when the earth electrode 5 is parallel with the axial direction of the earth electrode 5 are in a tapered shape that the average cross-section area S2 of the concave part 520 becomes small as the two border lines go to the opposed surface 51 side from the earth electrode's back surface 52. When the earth electrode 5 of the present embodiment is viewed from the axial direction of the spark plug 1, the area of the bottom 521 of the concave part 520 is smaller than the area of the opening 523 of the concave part 520.

In the present embodiment, as shown in FIG. 9, the area S1 of the opening 523 of the concave part 520 is larger than the area s of the convex part 510. Moreover, the average cross-section area S2 of the concave part 520 is larger than the area s of the convex part 510.

Here, the average cross-section area S2 of the concave part 520 is value V/H which is obtained by dividing volume V of the concave part 520 by depth H of the concave part 520.

Others have the same composition and the operation effect as those of the first embodiment.

Fourth Embodiment

Figure 10:
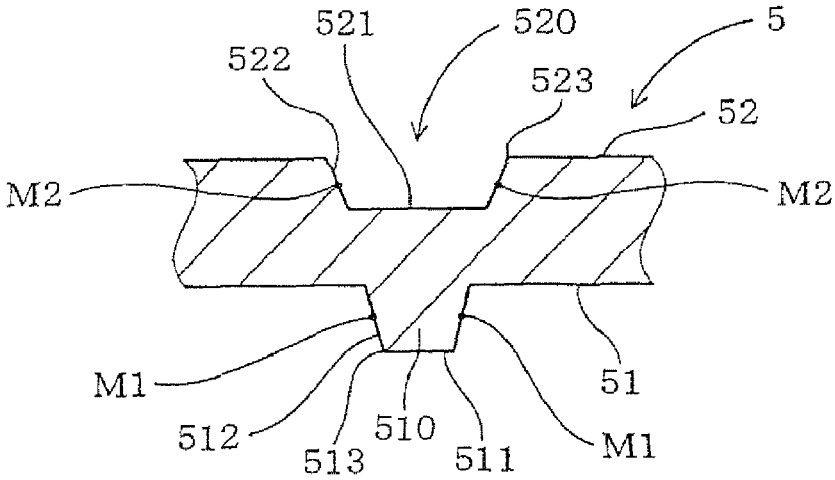
FIG. 10 is a sectional view of the earth electrode in the fourth embodiment.

As shown in FIG. 10, the present embodiment is an example of the earth electrode 5 whose cross section has the convex part 510 and the concave part 520 which are in approximately trapezoidal shapes concurrently when the earth electrode 5 is cut parallel with the axial direction of the earth electrode 5.

In the present embodiment, the area S1 of the opening 523 of the concave part 520 is larger than the average cross-section area s of the convex part 510. Moreover, the average cross-section area S2 of the concave part 520 is larger than the average cross-section area s of the convex part 510.

The average cross-section area s of the convex part 510 is value v/h which is obtained by dividing volume v of the convex part 510 by the amount h of projection of the convex part 510 here. Also, the average cross-section area S2 of the concave part 520 is value V/H which is obtained by dividing volume V of the concave part 520 by depth H of the concave part 520.

Others have the same composition and the operation effect as those of the first embodiment.

Fifth Embodiment

Figure 11:
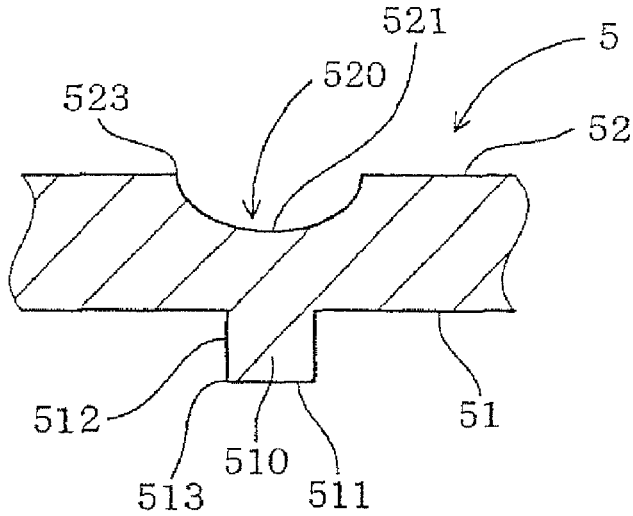
FIG. 11 is a sectional view of the earth electrode in the fifth embodiment.

As shown in FIG. 11, the present embodiment is an example of the earth electrode 5 which has the convex part 510 whose cross section is approximately rectangular when the earth electrode 5 is cut parallel with the axial direction of the earth electrode 5 and the concave part 520 whose curve line which appears in the cross section is semi-elliptic arc shape when the earth electrode 5 is cut in parallel with the axial direction of the grounding base material 50.

In the present embodiment, the area S1 of the opening 523 of the concave part 520 is larger than the area s of the convex part 510. Moreover, the average cross-section area S2 of the concave part 520 is larger than the area s of the convex part 510.

Here, the average cross-section area S2 of the concave part 520 is the average value of the cross-section area of the concave part 520 in the cross sections of the direction perpendicular to the axial direction of the concave part 520 between the opening 523 and the bottom 521 of the concave part 520.

Others have the same composition and the operation effect as those of the first embodiment.

Sixth Embodiment

Figure 12:
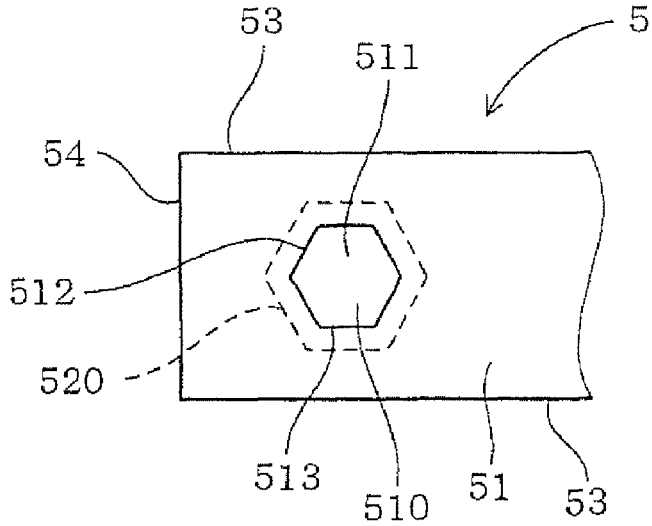
FIG. 12 is a top view of the earth electrode in the sixth embodiment.
Figure 13:
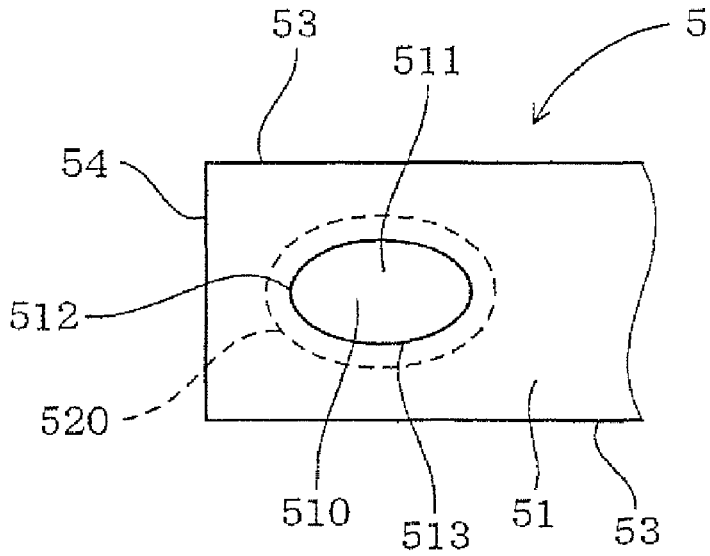
FIG. 13 is a top view of the earth electrode in the sixth embodiment.
Figure 14:
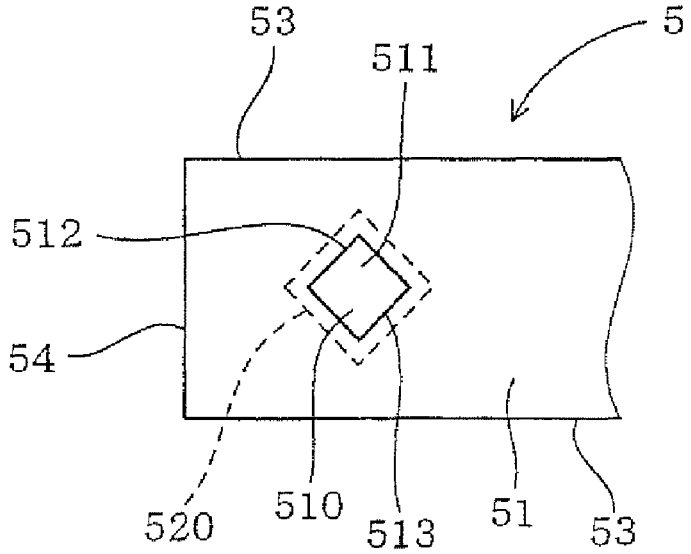
FIG. 14 is a top view of the earth electrode in the sixth embodiment.

As shown in FIG. 12-FIG. 14, the present embodiment is an example of the earth electrode 5 having the convex part 510 and the concave part 520 which have various shapes.

The earth electrode 5 shown in FIG. 12 has the convex part 510 and the concave part 520 which are hexagonal cylindrical shapes concurrently.

On the other hand, the earth electrode 5 shown in FIG. 13 has the convex part 510 and the concave part 520 which are elliptic cylindrical shapes concurrently.

Moreover, in the earth electrode 5 shown in FIG. 14, both the convex part 510 and the concave part 520 of approximately rectangular column shapes are those of the second embodiment but rotated approximately 45 degrees around the axial direction of the spark plug 1 concurrently.

Thus, although there are various shapes of the convex part 510 and the concave part 520, also in these cases, except the shapes of the convex part 510 and the concave part 520, the spark plug 1 has the same composition as the case of the first embodiment. Furthermore, also in these cases, the spark plug 1 has the same operation effect as the case of the first is embodiment.

However, the spark plug 1 of the present invention is not limited to the aspect mentioned above.

Seventh Embodiment

Figure 15:
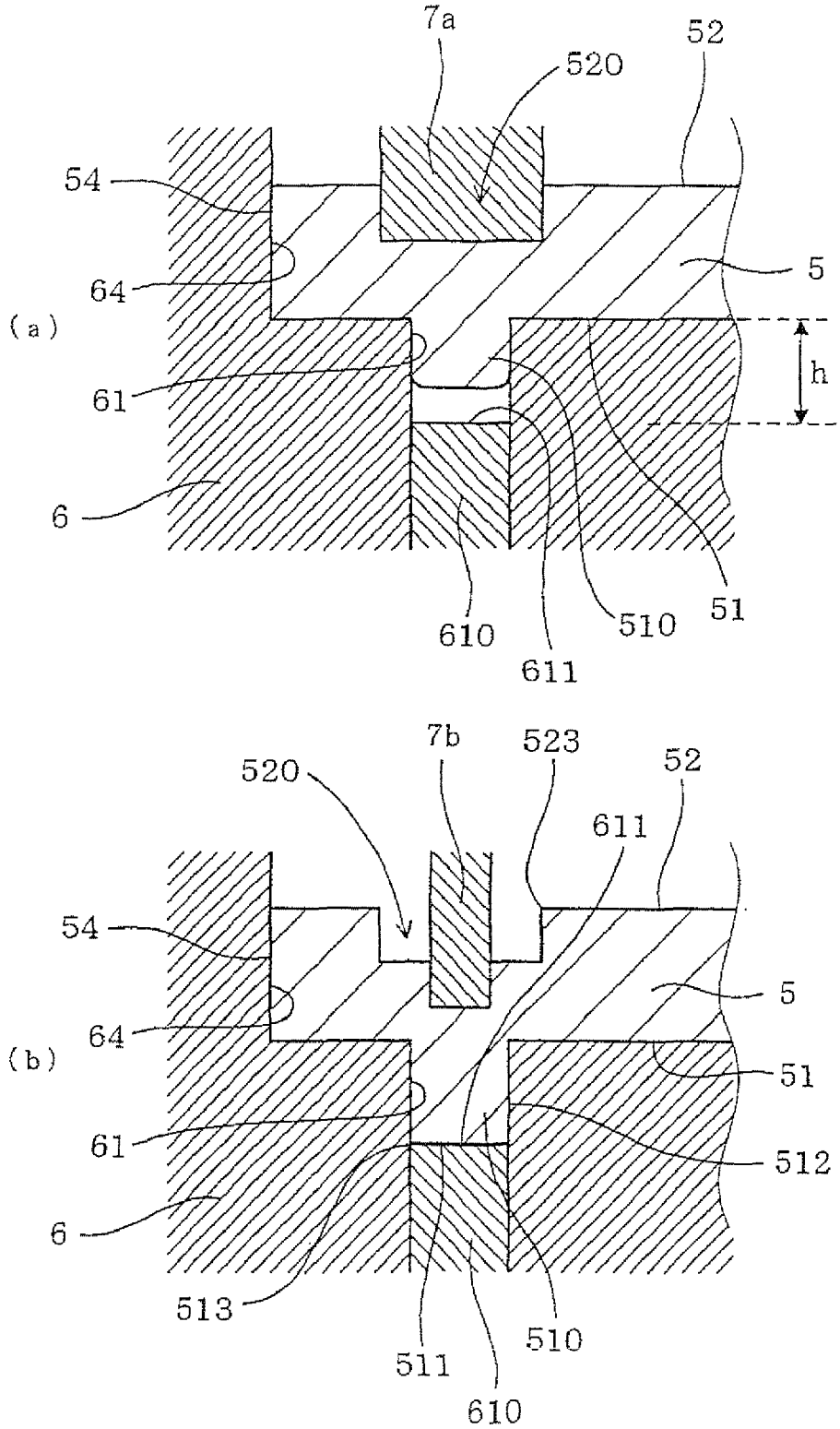
FIG. 15(*a*) is an explanatory diagram illustrating the state where is a part of the earth electrode's back surface is pressed with the pressing jig which has a same diameter as the opening of the concave part, and FIG. 15(*b*) is an explanatory diagram illustrating the state where a part of the earth electrode's back surface is pressed with the pressing jig which has a smaller diameter than the opening of the concave part in the seventh embodiment.
Figure 16:
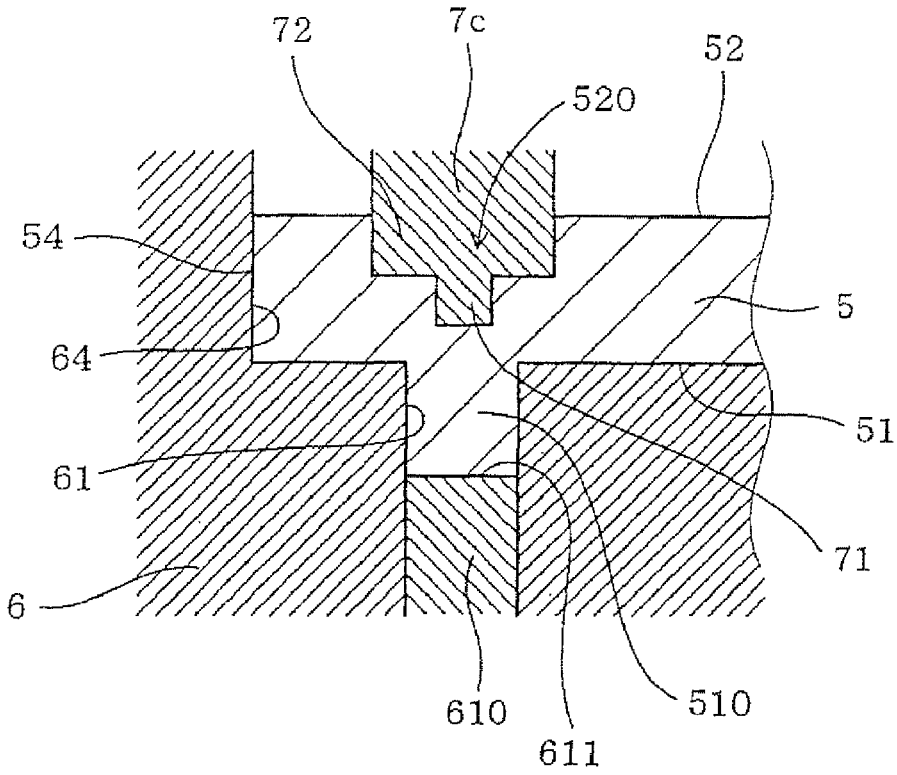
FIG. 16 is an explanatory diagram illustrating a pressing jig of another configuration in the seventh embodiment.

As shown in FIG. 15 and FIG. 16, the present embodiment is a modification example of pressing process which forms the convex part 510 by pressing a part of the earth electrode's back surface 52 with the pressing jig 7.

That is, FIG. 15 shows the state where the pressing process is performed twice. As shown in the same FIG. 15(*a*), in the first pressing process, the convex part 510 is formed using the pressing jig 7*a* which has the same radius as the radius of the opening 523 of the concave part 520.

Subsequently, as shown in the same FIG. 15(*b*), the convex part 510 is further projected in the second pressing process using pressing jig 7*b* which has a radius smaller than the radius of the convex part 510.

In the present embodiment, the corner part 513 can be formed certainly at the convex part 510.

Moreover, FIG. 16 shows the state where the pressing process is performed using the pressing jig 7*c* which has pressing parts 71 and 72 whose radiuses differ from each other. As specifically shown in FIG. 16, the pressing jig 7*c* has the pressing part 71 which is disposed at the tip side of the pressing direction and has a radius smaller than the radius of the convex part 510, and the pressing part 72 which is further extended to the direction opposed to the pressing direction from the back-end part of the pressing part 71 and has a radius smaller than the radius of the opening 523 of the concave part 520.

Also in this case, the corner part 513 can be certainly formed at the convex part 510 as same as the case shown in FIG. 15.

Other features are the same as the case of the first embodiment.

Eighth Embodiment

Figure 17:
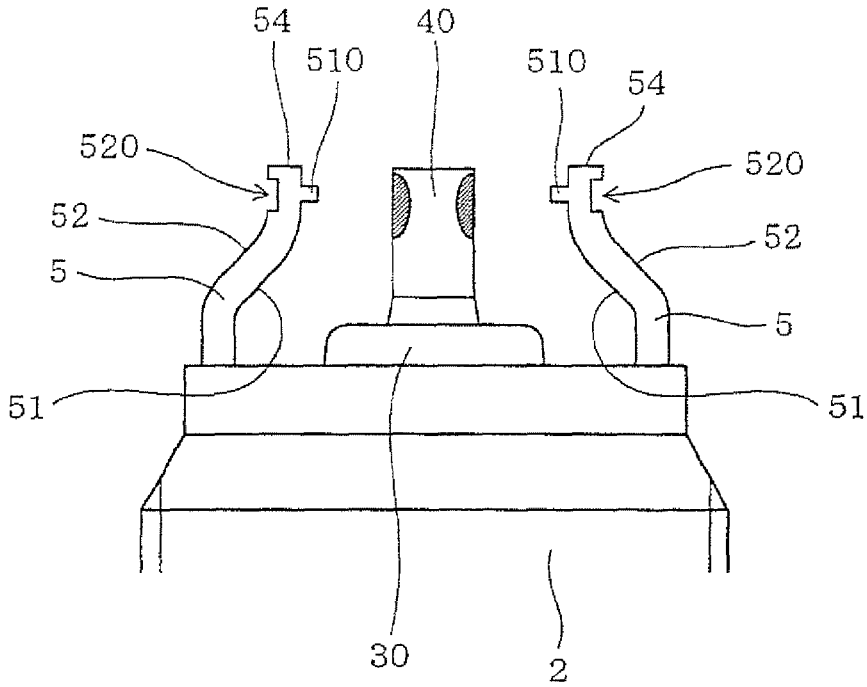
FIG. 17 is an explanatory diagram of the tip part of the multipole spark plug in the eighth embodiment.

As shown in FIG. 17, the present embodiment is an example of the multi-electrode type spark plug 1 which has two earth electrodes 5.

That is, the spark plug 1 of the present embodiment is equipped with two earth electrodes 5 which have the convex part 510. Specifically, two earth electrodes 5 are attached to the attachment fitting 2 so that the top surface 511 of each convex part 510 may oppose each other across the center electrode 4.

Moreover, each convex part 510 is projected toward the tip part of the center electrode 4.

In the present embodiment, the spark plug 1 excellent in ignition performance can be obtained.

Other features are the same as the case of the first embodiment.

Ninth Embodiment

Figure 18:
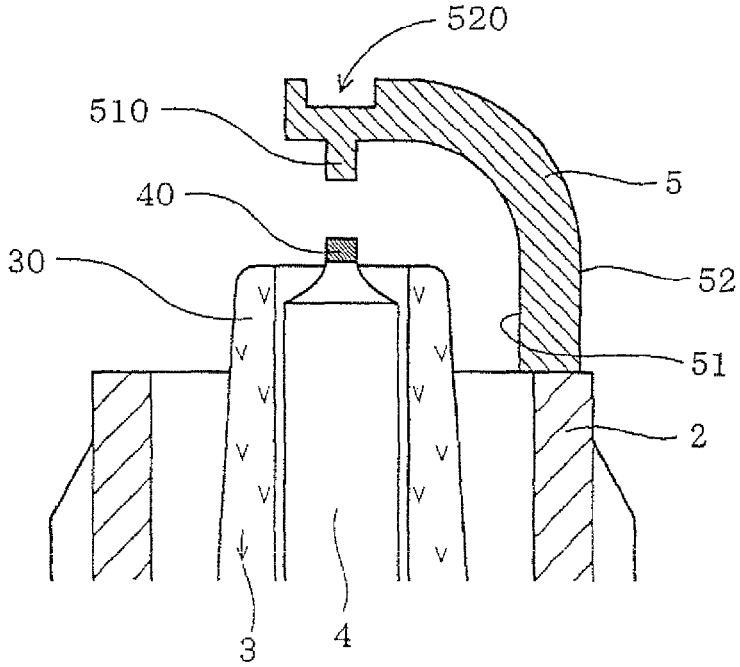
FIG. 18 is a sectional view of the tip part of a spark plug of another configuration in the ninth embodiment.

As shown in FIG. 18, the present embodiment is an example of the spark plug 1 constituted so that only the electrode tip part 40 attached to the tip part of the center electrode 4 might be located at the tip side of the axial direction of the spark plug 1 rather than the insulator tip part 30 of the insulator 3.

In the present embodiment, the spark plug which can reduce required voltage can be obtained while securing the outstanding smolder resistance.

Other features are the same as the case of the first embodiment.

Tenth Embodiment

Figure 19:
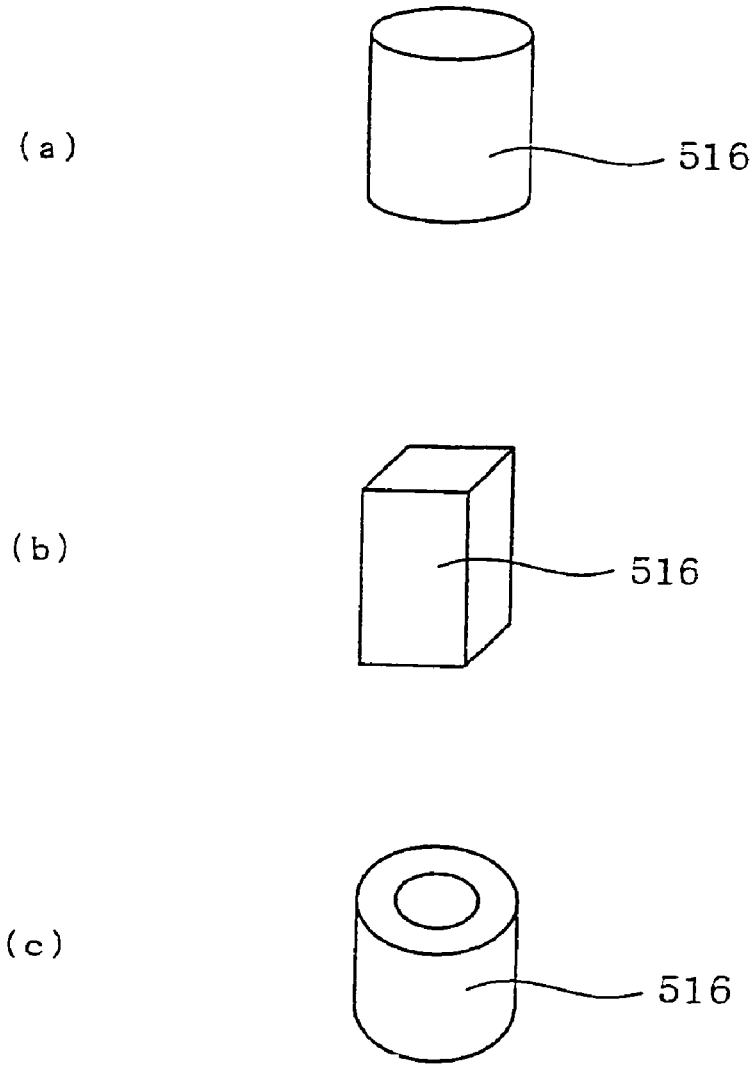
FIG. 19(*a*) is a perspective view of a chip of cylindrical shape attached to a top surface of the convex part, FIG. 19(*b*) is a perspective view of a chip of rectangular column shape attached to a top surface of the convex part, and FIG. 19(*c*) is a perspective view of a chip of circular ring shape attached to a top surface of the convex part in the tenth embodiment.
Figure 20:
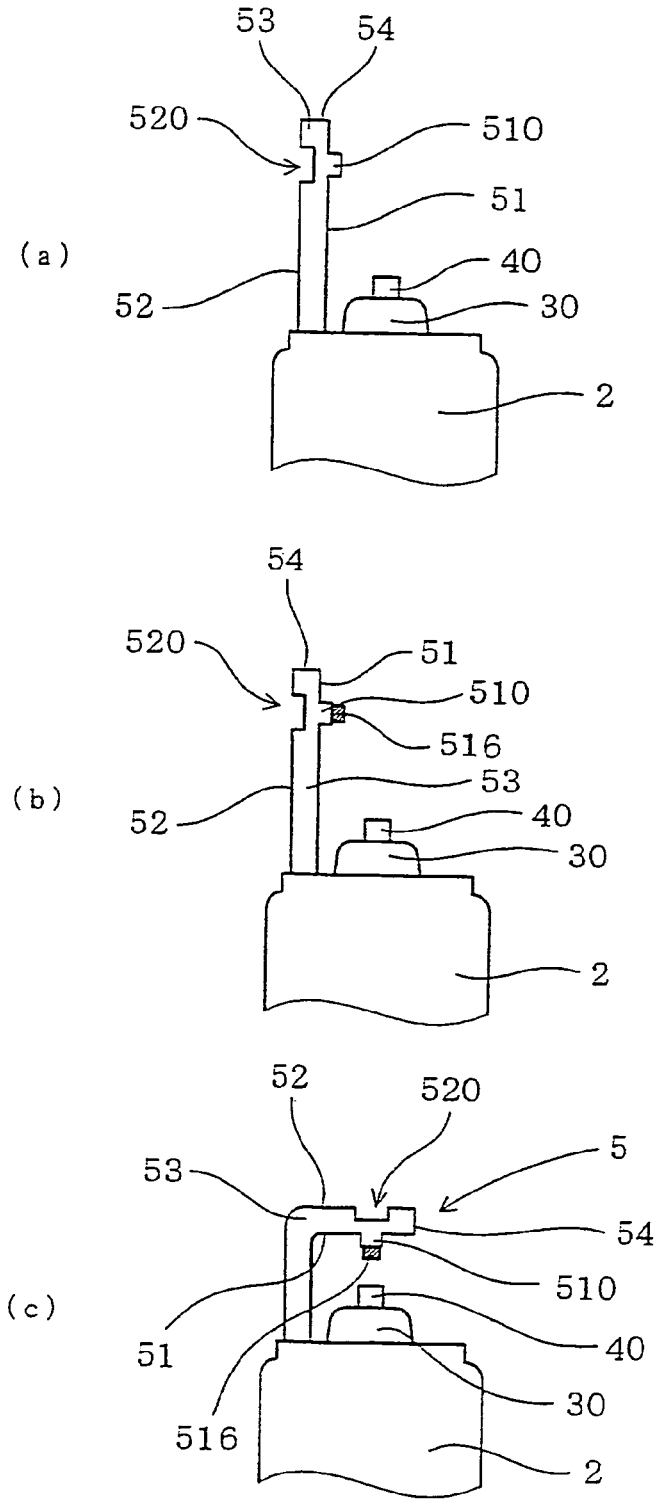
FIG. 20(*a*) is an explanatory diagram illustrating the state where the convex part is formed, FIG. 20(*b*) is an explanatory diagram illustrating the state where the chip is welded to the top surface of the convex part, and FIG. 20(*c*) is an explanatory diagram illustrating the state where the earth electrode was bent in the tenth embodiment.

As shown in FIG. 19 A-C and FIG. 20 A-C, the present embodiment is an example of the spark plug 1 having the earth electrode 5 to whose top surface 511 of the convex part 510 a chip 516 consisting of precious metals is further welded.

As the chip 516, for example, precious metals containing any one of Pt, Ir, Rh, and W as a major component can be used.

Moreover, the chip 516 can be formed as a chip of cylindrical shape as shown in FIG. 19(*a*), as a chip of rectangular shape as shown in FIG. 19(*b*), and as a chip of circular ring shape as shown in FIG. 19(*c*) by changing height variously according to the amount h of projection of the convex part 510.

The production procedure of the spark plug 1 of the present embodiment is explained with FIG. 20.

That is, as shown in FIG. 20(*a*), the convex part 510 is formed by pressing a part of the earth electrodes 5 with the pressing jig 7 as same as the case of the first embodiment.

Subsequently, as shown in FIG. 20(*b*), the chip 516 is welded to the tip part of the convex part 510 by resistance welding for example. In case that the chip 516 is long, resistance welding and laser welding can also be used together.

Subsequently, as shown in FIG. 20(*c*), the earth electrode 5 is bent so that the chip 516 consisting of the precious metals and the convex part 510 which may face the electrode tip part 40 of the center electrode 4.

The spark plug 1 of the present embodiment is producible with the above procedure.

Like the present embodiment, when attaching the chip 516 consisting of the precious metals to the top surface 511 of the convex part 510 further, even if it is the case where the amount h of projection from the opposed surface 51 is made the same, consumed quantity of the precious metals can be lessened by the quantity of the convex part 510 formed to the earth electrode 5 rather than the case where the chip 516 is simply attached to the opposed surface 51. For this reason, the material cost of the spark plug 1 can be reduced. Furthermore, since the chip 516 is attached in the direction which approaches the electrode tip part 40 further rather than the top surface 511 of the convex part 510, required voltage can be reduced rather than the case where the convex part 510 is simply provided whereby the ignition performance of the spark plug 1 can be raised.

Other features are the same as the case of the first embodiment.

Eleventh Embodiment

Figure 21:
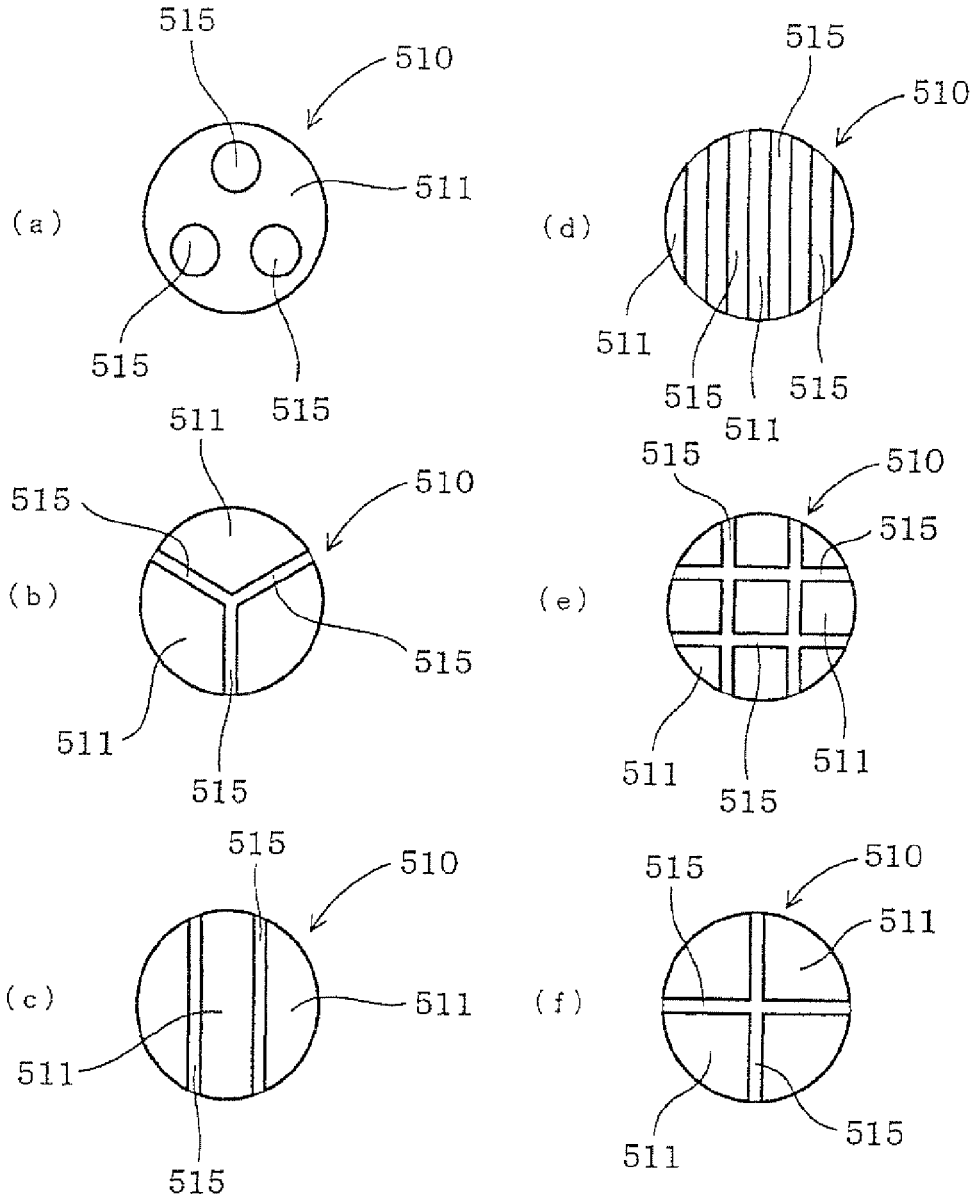
FIG. 21(*a*) is a top view of a groove portion formed to the top surface of the convex part, FIG. 21(*b*) is a top view of a groove portion of another form formed to the top surface of the convex part, FIG. 21(*c*) is a top view of a groove portion of another form formed to the top surface of the convex part, FIG. 21(*d*) is a top view of a groove portion of another form formed to the top surface of the convex part, FIG. 21(*e*) is a top view of a groove portion of another form formed to the top surface of the convex part, and FIG. 21(*f*) is a top view of a groove portion of another form formed to the top surface of the convex part in is the eleventh embodiment.

As shown in FIG. 21, the present embodiment is an example of the earth electrode 5 with which groove portions 515 of various shapes are formed in the top surface 511.

In the top surface 511 of the convex part 510, the groove portion 515 of various shapes can be formed, such as three groove portions 515 of cylindrical shape as shown in FIG. 21(*a*), three linear groove portions 515 connected at the center of the top surface 511, two linear groove portions 515 arranged in parallel.

Moreover, in the top surface 511 of the convex part 510, the groove portion 515 of various shapes can be formed, such as a plurality of the linear groove portions 515 arranged in parallel as shown in FIG. 21(*d*), groove portion 515 of lattice-shaped as shown in FIG. 21(*e*), two linear groove portions 515 crossing at the center of the top surface 511.

Each groove portion 515 is formed so that it may become depressed in the earth electrode's back surface 52 side in the top surface 511 of the convex part 510.

Figure 22:
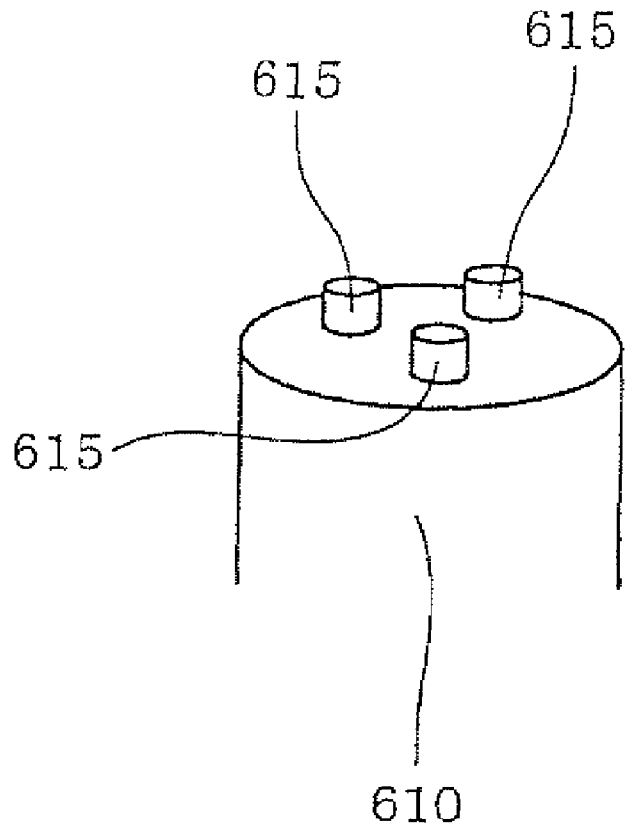
FIG. 22 is a perspective view of a movable mold which has a groove formation part for forming the groove portion in the eleventh embodiment.

In forming the groove portion 515 of cylindrical shape as shown in FIG. 21(*a*) for example, the movable mold 610, as shown in FIG. 22, which has the mold surface 611 equipped with the groove formation part 615 with cylindrical shape of a reverse pattern of the shape of the groove portion 515 can be used.

Other features are the same as the case of the first embodiment.

Twelfth Embodiment

Figure 23:
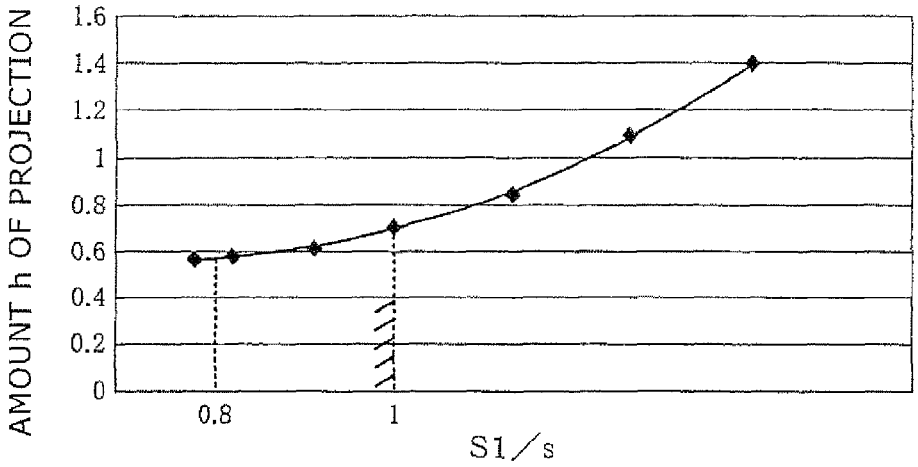
FIG. 23 is a graph plotting the relation between S1/s, which is the relation of the area S1 of the opening 523 of the concave part 520 and the average cross-section area s of the section of the convex part 510, and the amount h of projection of the convex part 510 in the twelfth embodiment.

As shown in FIG. 23, the present embodiment is an example which investigated the relation between S1/s, which shows the relation between the area S1 of the opening 523 of the concave part 520 and the average cross-section area s of the cross section of the convex part 510, and the amount h of projection of the convex part 510.

Specifically, the earth electrode 5 whose value of S1/s differs variously by changing the diameter d of the convex part 510 was produced (for reference symbols, refer to FIG. 3), while fixing the depth H of the concave part 520 to 1.2 mm, the diameter D of the concave part 520 to 1.8 mm, the thickness T of the earth electrode 5 to 1.6 mm and the width W of the earth electrode 5 to 2.8 mm.

Then the amount h of projection of the convex part 510 in each case was measured.

A measurement result is shown in FIG. 23.

As shown in FIG. 23, when a relation of S1/s>=1 is realized, the amount h of projection of the convex part 510 exceeds 0.7 mm whereby the convex part 510 can be fully projected.

On the other hand, if the relation of S1/s<1 is realized, the amount h of projection of the convex part 510 is less than 0.7 mm, and it turns out that it is difficult to make the convex part 510 fully project. Especially in the case of S1/s<0.8, a relation of H>2h is realized and the heat dissipation path may not be fully secured.

From the foregoing, it turns out that it is important that the relation of S1/s>=1 is realized from the viewpoint of making the convex part 510 fully project.

Meanwhile, in the present embodiment, although the experimental test was conducted with the earth electrode 5 whose convex part 510 is cylindrical shape. Even if it is the case where the side surface 512 of the convex part 510 or the side surface 522 of the concave part 520 is a tapered shape, the same result will be obtained.

Thirteenth Embodiment

Figure 24:
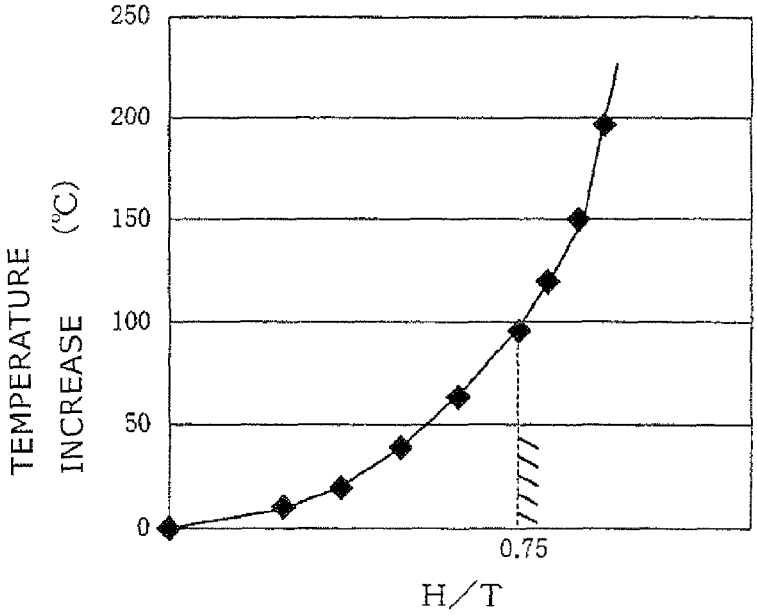
FIG. 24 is a graph plotting the relation between H/T, which is the relation of depth H of the concave part 520 and thickness T of the earth electrode 5, and the temperature of the earth electrode 5 in the thirteenth embodiment.
Figure 25:
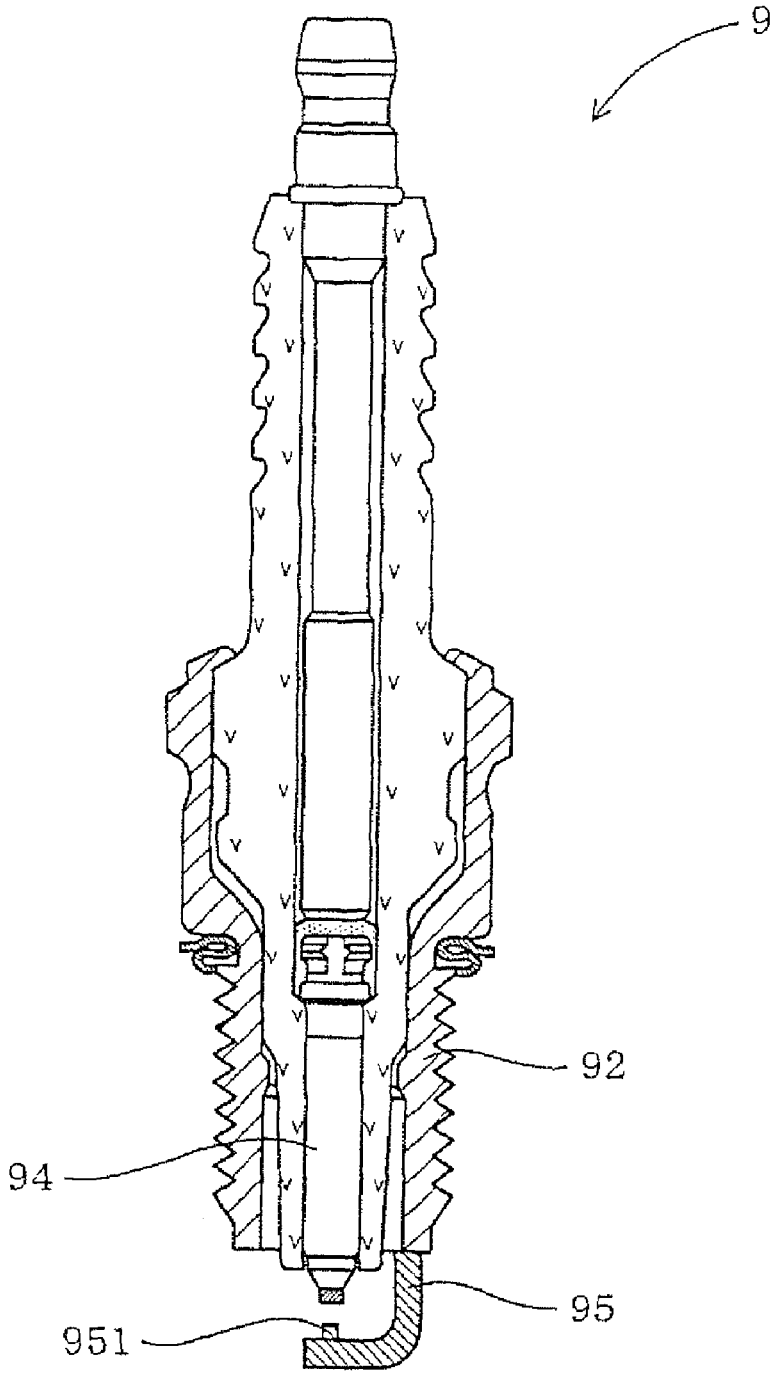
FIG. 25 is a sectional view of a spark plug in the conventional example.
Figure 26:
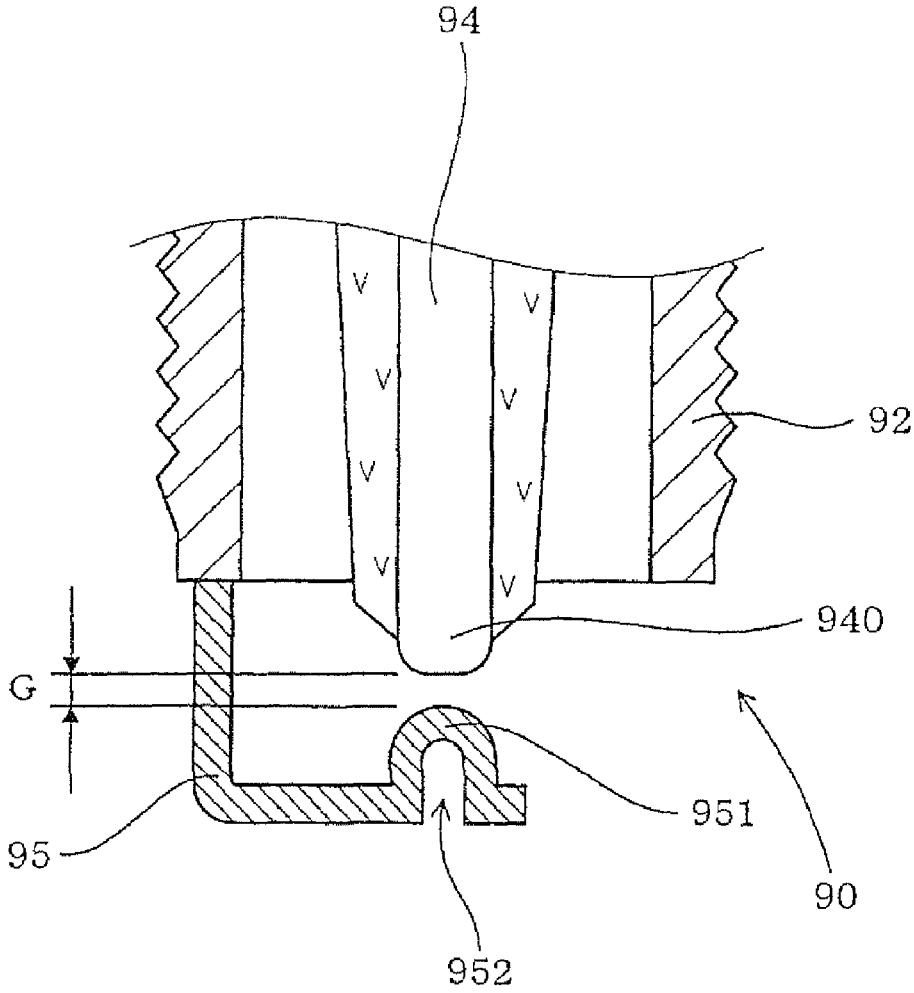
FIG. 26 is a sectional view of a tip part of the spark plug in the conventional example.

As shown in FIG. 24, the present embodiment is an example which investigated the relation between H/T, which shows the relation between the depth H of the concave part 520 and the thickness T of the earth electrode 5, and the temperature of the earth electrode 5.

Specifically, the earth electrode 5 whose value of H/T differs variously by changing the depth H of the concave part 520 variously was produced (for reference symbols, refer to FIG. 3), while fixing the diameter D of the concave part 520 to 2.0 mm, the diameter d of the convex part 510 to 1.5 mm, the width W of the earth electrode 5 to 2.8 mm and the thickness T of the earth electrode 5 to 1.6 mm, an earth electrode 5 by 1.6 mm.

The valuation method was performed as follows.

First, an earth electrode not having the convex part 510 or the concave part 520 either (hereinafter called a comparison sample) and the earth electrodes 5 were heated so that the temperature of both the comparison sample and each earth electrode 5 might become 730 degrees C.

Second, the temperature of the portion near the tip portion 54 in the comparison sample and each earth electrode 5 was measured.

Subsequently, the increased temperature of each earth electrode 5 to the temperature of the comparison sample was computed.

In the present embodiment, the criterion of temperature increase over the comparison sample was set to 100 degrees C. This is based on that heat resistance falls and there is a possibility that the lowering of the life of the earth electrode 5 may become remarkable, when a rise in heat 100 degrees C. or more arises.

An evaluation result is shown in FIG. 24.

As will be noted from FIG. 24, when the relation of H/T<=0.75 is realized, increased temperature to the comparison sample can be made small enough with 100 degrees C. or less.

On the other hand, when the relation of H/T>0.75 is realized, it turns out that the temperature increase to the comparison sample exceeds 100 degrees C., and the rate of temperature increase increases rapidly further.

From the foregoing, it turns out that it is important that the relation of H/T<=0.75 is realized from the viewpoint of heat dissipation of the earth electrode 5.

Meanwhile, in the present embodiment, although the experimental test was conducted with the earth electrode 5 whose convex part 510 has cylindrical shape. Even if it is the case where the side surface 512 of the convex part 510 or the side surface 522 of the concave part 520 is a tapered shape, the same result will be obtained.

What is claimed is:

1. A spark plug for an internal-combustion engine, comprising:

an attachment fitting which provides a screw part to an outer circumference of the attachment fitting, an insulator held by the attachment fitting so that the insulator tip part projects;

a center electrode held by the insulator so that the electrode tip part projects from the insulator tip part; and an earth electrode which forms a spark discharge gap between the center electrode and the earth electrode, wherein:

the earth electrode has a convex part formed by projecting toward the center electrode a part of an opposed surface of the earth electrode, that faces the center electrode, and a concave part formed toward the opposed surface from a back surface of the earth electrode, that is the reverse side of the earth electrode with respect to the opposed surface, while the earth electrode is fixed to the attachment fitting;

the convex part is disposed so that the extension of a shaft center of the convex part passes through the area in which the concave part is formed;

the convex part has a top surface that is formed as a flat planar surface; and a relation of S1>=s is realized when an area of an opening of the concave part is set to S1 and an average cross-section area of a cross section of the convex part perpendicular to an axial direction of the spark plug is set to s.

2. The spark plug for the internal-combustion engine according to claim 1, wherein a relation of S2>=s is realized when an average cross-section area of a cross section of the concave part perpendicular to an axial direction of the spark plug is set to S2.

3. The spark plug for the internal-combustion engine according to claim 1, wherein a relation of H<=(3/4)T is realized when the thickness of the earth electrode is set to T and the depth of the concave part in the axial direction is set to H.

4. The spark plug for the internal-combustion engine according to claim 1, wherein a relation of D>=d is realized when both the convex part and the concave part have approximately cylindrical shapes, the diameter of the convex part is set to d and the diameter of the concave part is set to D.

5. The spark plug for the internal-combustion engine according to claim 1, wherein a relation of H<=2h is realized when the amount of projection of the convex part in the axial direction of the spark plug is set to h and the amount of projection of the concave part in the axial direction of the spark plug is set to H.

6. The spark plug for the internal-combustion engine according to claim 1, wherein the convex part has a groove portion concaved toward the earth electrode's back surface in the earth electrode's top surface opposed to the center electrode.

7. The spark plug for the internal-combustion engine according to claim 1, wherein a chip made of either a) precious metals containing any one of Pt, Ir, and Rh, or b) a metal of W as a major component is welded to the top surface of the convex part of the earth electrode opposed to the center electrode.

8. A spark plug for an internal-combustion engine, comprising:

an attachment fitting which provides a screw part to an outer circumference of the attachment fitting;

an insulator held by the attachment fitting so that the insulator tip part projects;

a center electrode held by the insulator so that the electrode tip part projects from the insulator tip part; and an earth electrode which forms a spark discharge gap between the center electrode and the earth electrode, wherein:

the earth electrode has a convex part formed by projecting toward the center electrode a part of an opposed surface of the earth electrode, that faces the center electrode, and a concave part formed toward the opposed surface from a back surface of the earth electrode, that is the reverse side of the earth electrode with respect to the opposed surface, while the earth electrode is fixed to the attachment fitting;

the convex part is disposed so that the extension of a shaft center of the convex part passes through the area in which the concave part is formed;

the convex part has a top surface that is formed as a flat planar surface; and a relation of S1>=s is realized when an area of an opening of the concave part is set to S1 and an average cross-section area of a cross section of the convex part perpendicular to an axial direction of the spark plug is set to s;

a relation of S2>=s is realized when an average cross-section area of a cross section of the concave part perpendicular to an axial direction of the spark plug is set to S2; and a relation of H<=(3/4)T is realized when the thickness of the earth electrode is set to T and the depth of the concave part in the axial direction is set to H.

9. The spark plug for the internal-combustion engine according to claim 8, wherein a relation of H<=2h is realized when the amount of projection of the convex part in the axial direction of the spark plug is set to h and the amount of projection of the concave part in the axial direction of the spark plug is set to H.

10. The spark plug for the internal-combustion engine according to claim 8, wherein the convex part has a groove portion concaved toward the earth electrode's back surface in the earth electrode's top surface opposed to the center electrode.

11. The spark plug for the internal-combustion engine according to claim 8, wherein a chip made of either precious metals containing any one of Pt, Ir and Rh or a metal of W as a major component is welded to the top surface of the convex part of the earth electrode opposed to the center electrode.

12. A spark plug for an internal-combustion engine, comprising:

an attachment fitting which provides a screw part to an outer circumference of the attachment fitting, an insulator held by the attachment fitting so that the insulator tip part projects;

a center electrode held by the insulator so that the electrode tip part projects from the insulator tip part; and an earth electrode which forms a spark discharge gap between the center electrode and the earth electrode, wherein:

the earth electrode has a convex part formed by projecting toward the center electrode a part of an opposed surface of the earth electrode, that faces the center electrode, and a concave part formed toward the opposed surface from a back surface of the earth electrode, that is the reverse side of the earth electrode with respect to the opposed surface, while the earth electrode is fixed to the attachment fitting;

the convex part is disposed so that the extension of a shaft center of the convex part passes through the area in which the concave part is formed;

the convex part has a top surface that is formed as a flat planar surface; and a relation of S1>=s is realized when an area of an opening of the concave part is set to S1 and an average cross-section area of a cross section of the convex part perpendicular to an axial direction of the spark plug is set to s;

a relation of S2>=s is realized when an average cross-section area of a cross section of the concave part perpendicular to an axial direction of the spark plug is set to S2, a relation of H<=(3/4)T is realized when the thickness of the earth electrode is set to T and the depth of the concave part in the axial direction is set to H; and a relation of D>=d is realized when both the convex part and the concave part have approximately cylindrical shapes, the diameter of the convex part is set to d and the diameter of the concave part is set to D.

13. The spark plug for the internal-combustion engine according to claim 12, wherein a relation of H<=2h is realized when the amount of projection of the convex part in the axial direction of the spark plug is set to h and the amount of projection of the concave part in the axial direction of the spark plug is set to H.

14. The spark plug for the internal-combustion engine according to claim 12, wherein the convex part has a groove portion concaved toward the earth electrode's back surface in the earth electrode's top surface opposed to the center electrode.

15. The spark plug for the internal-combustion engine according to claim 12, wherein a chip made of either precious metals containing any one of Pt, Ir, and Rh or a metal of W as a major component is welded to the top surface of the convex part of the earth electrode opposed to the center electrode.

* * * * *